US009482080B2

(12) United States Patent
Wright et al.

(10) Patent No.: US 9,482,080 B2
(45) Date of Patent: Nov. 1, 2016

(54) HYDROCARBON RESOURCE HEATING APPARATUS INCLUDING RF CONTACTS AND GUIDE MEMBER AND RELATED METHODS

(71) Applicant: HARRIS CORPORATION, Melbourne, FL (US)

(72) Inventors: Brian N. Wright, Indialantic, FL (US); Murray Hann, Malabar, FL (US); Raymond C. Hewit, Palm Bay, FL (US); Zachary L. Linkewich, Cochrane (CA); Alan Watt, Cochrane (CA)

(73) Assignee: HARRIS CORPORATION, Melbourne, FL (US)

( * ) Notice: Subject to any disclaimer, the term of this patent is extended or adjusted under 35 U.S.C. 154(b) by 136 days.

(21) Appl. No.: 14/491,545

(22) Filed: Sep. 19, 2014

(65) Prior Publication Data

US 2015/0129223 A1 May 14, 2015

Related U.S. Application Data

(63) Continuation-in-part of application No. 14/076,501, filed on Nov. 11, 2013, now Pat. No. 9,328,593.

(51) Int. Cl.

| | |
|---|---|
| ***E21B 43/24*** | (2006.01) |
| ***E21B 36/04*** | (2006.01) |
| ***E21B 17/10*** | (2006.01) |

(52) U.S. Cl.

CPC ..... *E21B 43/2401* (2013.01); *E21B 17/10* (2013.01); *E21B 36/04* (2013.01)

(58) Field of Classification Search

CPC ..... E21B 43/2401; E21B 36/04

See application file for complete search history.

(56) References Cited

U.S. PATENT DOCUMENTS

| | | | |
|---|---|---|---|
| 4,553,592 | A | 11/1985 | Looney et al. |
| 5,065,819 | A | 11/1991 | Kasevich |
| 5,455,548 | A | 10/1995 | Grandchamp et al. |
| 7,441,597 | B2 | 10/2008 | Kasevich |
| 2007/0137852 | A1 | 6/2007 | Considine et al. |
| 2010/0078163 | A1 | 4/2010 | Banerjee et al. |
| 2010/0294488 | A1 | 11/2010 | Wheeler et al. |
| 2010/0294489 | A1 | 11/2010 | Dreher, Jr. et al. |
| 2012/0067580 | A1 | 3/2012 | Parsche |
| 2014/0110395 | A1 | 4/2014 | Parsche |
| 2014/0216714 | A1* | 8/2014 | Dittmer ..... E21B 43/2401 166/57 |
| 2015/0129222 | A1 | 5/2015 | Wright et al. |
| 2015/0129224 | A1 | 5/2015 | Wright et al. |

OTHER PUBLICATIONS

Centralizer Recorder Carrier, Select Energy Systems Inc., http://www.selectesi.com/images/downloads/ct_downhole_equipment/Centralizer-Recorder-Carrier.pdf, 2008, downloaded Sep. 23, 2014, p. 1.

(Continued)

*Primary Examiner* — Zakiya W Bates

(74) *Attorney, Agent, or Firm* — Allen, Dyer, Doppelt, Milbrath & Gilchrist, P.A.

(57) ABSTRACT

A device for heating hydrocarbon resources in a subterranean formation having a wellbore therein may include a tubular radio frequency (RF) antenna within the wellbore and a tool slidably positioned within the tubular RF antenna. The tool may include an RF transmission line and at least one RF contact coupled to a distal end of the RF transmission line and biased in contact with the tubular RF antenna. The tool may also include a guide member extending longitudinally outwardly from the distal end of the RF transmission line.

26 Claims, 34 Drawing Sheets

(56) References Cited

OTHER PUBLICATIONS

Coiled Tubing Centralizer, Select Energy Systems Inc., http://www.selectesi.com/images/downloads/ct_downhole_equipment/Coiled-Tubing-Centralizer.pdf , 2008, downloaded Sep. 23, 2014, p. 1.

Products—Sub Surface, Select Energy Systems Inc., http://www.selectesi.com/Sub-Surface/sub-surface.html (5 pgs.), 2014, downloaded Jun. 4, 2014, pp. 1-5.

Wright et al., U.S. Appl. No. 14/167,039, filed Jan. 29, 2014.

* cited by examiner

HYDROCARBON RESOURCE HEATING APPARATUS INCLUDING RF CONTACTS AND GUIDE MEMBER AND RELATED METHODS

RELATED APPLICATION

The present application is a continuation-in-part of U.S. application Ser. No. 14/076,501, filed Nov. 11, 2013, and assigned to the assignee of the present application, and the entire contents of which are herein incorporated by reference.

FIELD OF THE INVENTION

The present invention relates to the field of hydrocarbon resource recovery, and, more particularly, to hydrocarbon resource recovery using RF heating.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in tar sands where their viscous nature does not permit conventional oil well production. Estimates are that trillions of barrels of oil reserves may be found in such tar sand formations.

In some instances these tar sand deposits are currently extracted via open-pit mining. Another approach for in situ extraction for deeper deposits is known as Steam-Assisted Gravity Drainage (SAGD). The heavy oil is immobile at reservoir temperatures and therefore the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the pay zone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen which allows it to flow down into the lower producer well where it is collected and recovered. The steam and gases rise due to their lower density so that steam is not produced at the lower producer well and steam trap control is used to the same affect. Gases, such as methane, carbon dioxide, and hydrogen sulfide, for example, may tend to rise in the steam chamber and fill the void space left by the oil defining an insulating layer above the steam. Oil and water flow is by gravity driven drainage, into the lower producer.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, although due to the 2008 economic downturn work on new projects has been deferred, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided, namely an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Application No. 2010/0294489 to Dreher, Jr. et al. discloses using microwaves to provide heating. An activator is injected below the surface and is heated by the microwaves, and the activator then heats the heavy oil in the production well. U.S. Published Application No. 2010/0294488 to Wheeler et al. discloses a similar approach.

U.S. Pat. No. 7,441,597 to Kasevich discloses using a radio frequency generator to apply RF energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which impacts the environment. Limited water resources may also limit oil recovery. SAGD is also not an available process in permafrost regions, for example.

Moreover, despite the existence of systems that utilize RF energy to provide heating, such systems may not be relatively reliable and robust. For example, such systems may not allow for removal or reuse in additional wellbores.

SUMMARY OF THE INVENTION

An apparatus is for heating hydrocarbon resources in a subterranean formation having a wellbore therein. The apparatus may include a tubular radio frequency (RF) antenna within the wellbore, and a tool slidably positioned within the tubular RF antenna. The tool may include an RF transmission line and at least one RF contact coupled to a distal end of the RF transmission line and biased in contact with the tubular RF antenna. The tool may also include a guide member extending longitudinally outwardly from the distal end of the RF transmission line.

The guide member may include an elongate member and at least one centralizer carried thereby. The at least one centralizer may include a plurality of longitudinally spaced apart centralizers, for example. The at least one centralizer may include a tubular body and a plurality of longitudinally extending fins spaced around a periphery of the tubular body.

The at least one RF contact may include at least one conductive wound spring, for example. In other embodiments, the at least one RF contact may include at least one deployable RF contact moveable between a retracted position and a deployed position.

The tubular RF antenna may include first and second conductive sections and an insulator therebetween. The RF transmission line may include an inner conductor and an outer conductor surrounding the inner conductor. The at least one RF contact may include a first set of RF contacts coupled to the outer conductor and biased in contact with an adjacent inner surface of the first conductive section, and a second set of RF contacts coupled to the inner conductor and biased in contact with an adjacent inner surface of the second conductive section, for example.

The tool may further include an outer tube surrounding the RF transmission line. The apparatus may also include an RF power source configured to supply RF power, via the RF transmission line, to the tubular RF antenna.

A method aspect is directed to a method for heating hydrocarbon resources in a subterranean formation having a wellbore therein with a tubular radio frequency (RF) antenna within the wellbore. The method may include slidably positioning a tool within the tubular RF antenna. The tool includes an RF transmission line and at least one RF contact coupled to a distal end of the RF transmission line and to be biased in contact with the tubular RF antenna. The slidably positioning is aided by a guide member extending longitudinally outwardly from the distal end of the RF transmission line. The method may also include supplying RF power to the tubular RF antenna via the RF transmission line.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate like elements in different embodiments.

Figure 1:
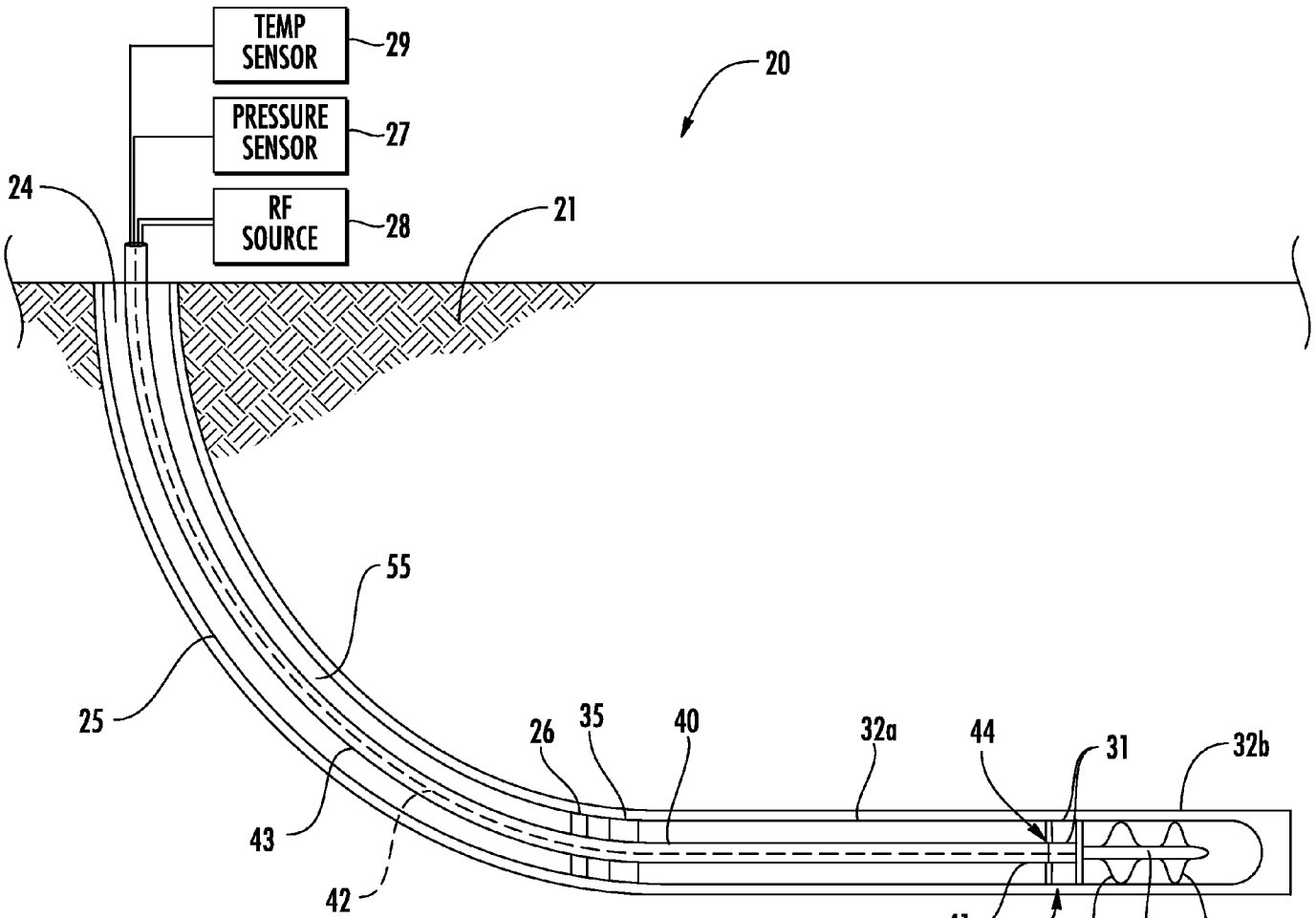
FIG. 1 is a schematic diagram of a subterranean formation including an apparatus in accordance with the present invention.
Figure 2:
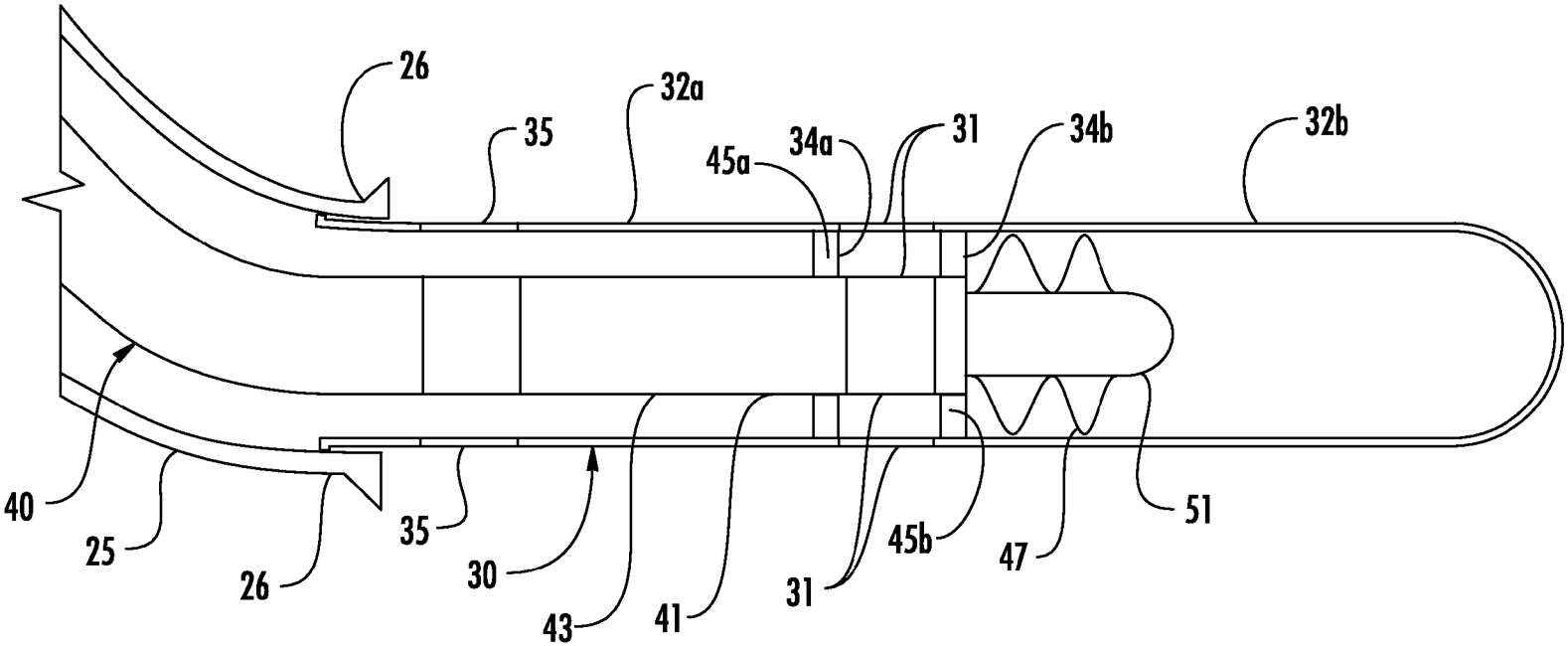
FIG. 2 is an enlarged schematic diagram of a portion of the apparatus of FIG. 1.
Figure 3:
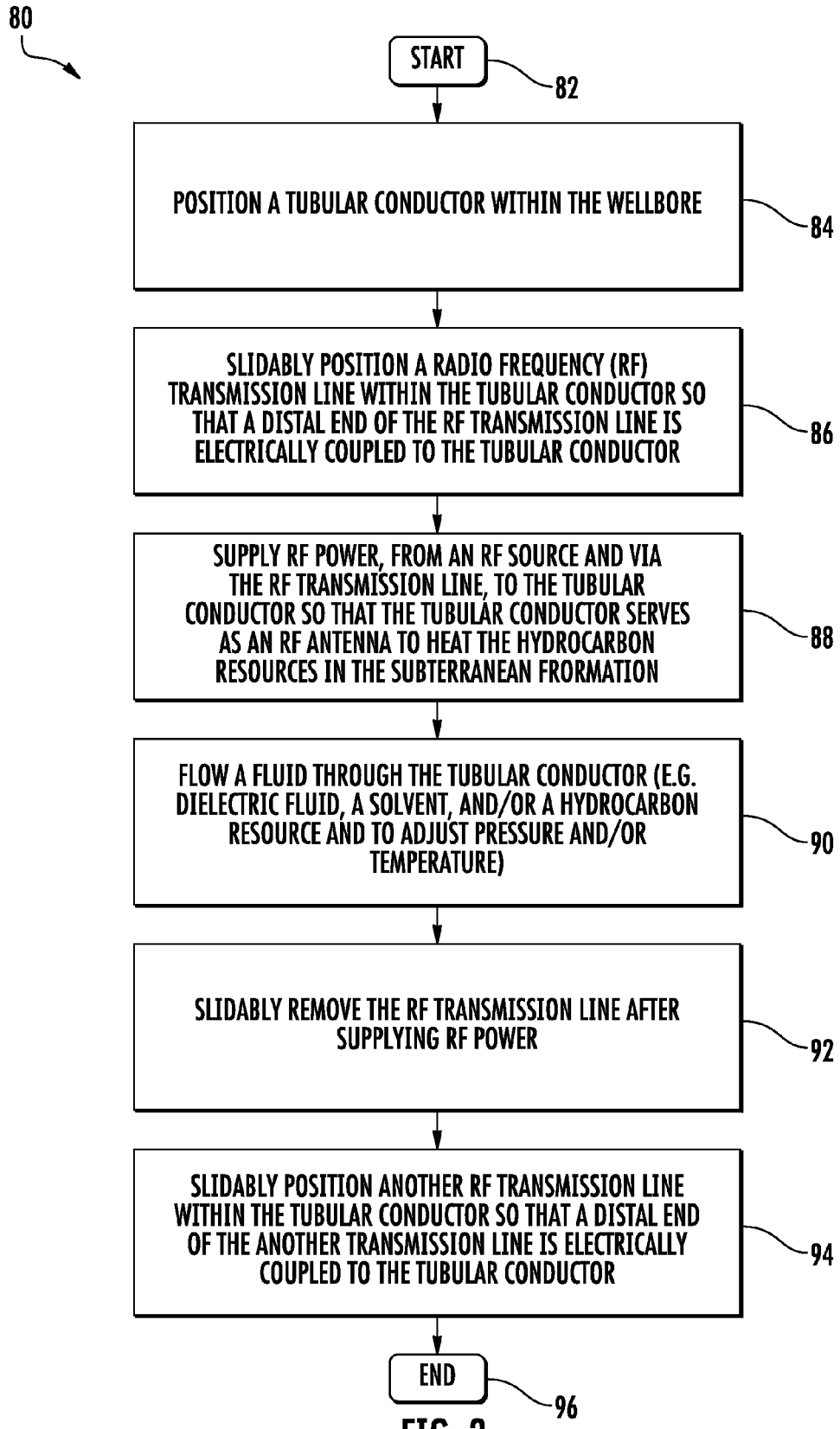
FIG. 3 is a flow chart of a method of heating hydrocarbon resources in accordance with the present invention.

Referring initially to FIGS. 1 and 2, and with respect to the flow chart 80 in FIG. 3, an apparatus 20 and method for heating hydrocarbon resources in a subterranean formation 21 are described. The subterranean formation 21 includes a wellbore 24 therein. The wellbore 24 illustratively extends laterally within the subterranean formation 21. In other embodiments, the wellbore 24 may be a vertically extending wellbore. Although not shown, in some embodiments a respective second or producing horizontal wellbore may be used below the wellbore 24, such as would be found in a SAGD implementation, for the collection of oil, etc., released from the subterranean formation 21 through RF heating.

Figure 4:
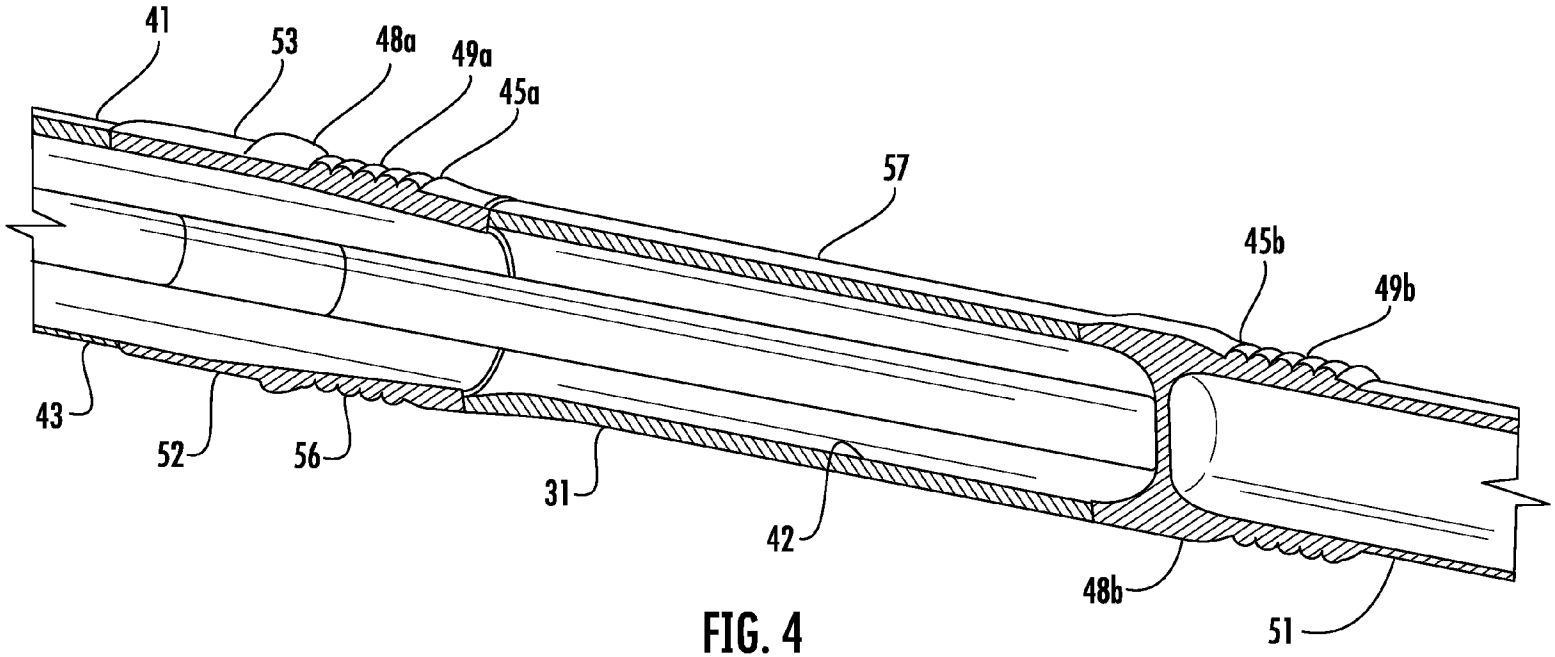
FIG. 4 is a partial cross-sectional view of a portion of the apparatus of FIG. 1.
Figure 5:
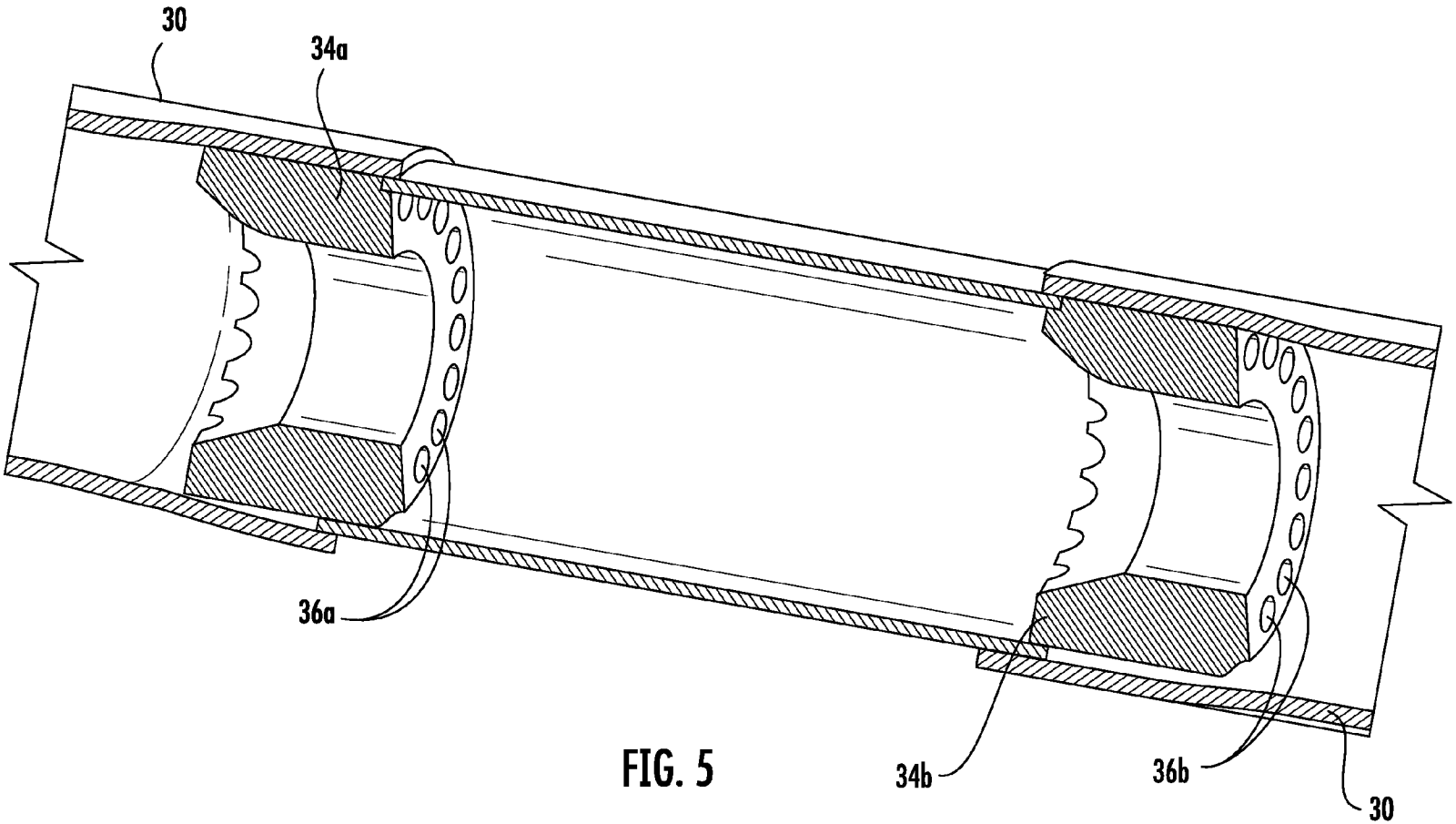
FIG. 5 is another partial cross-sectional view of a portion of the apparatus of FIG. 1.
Figure 6:
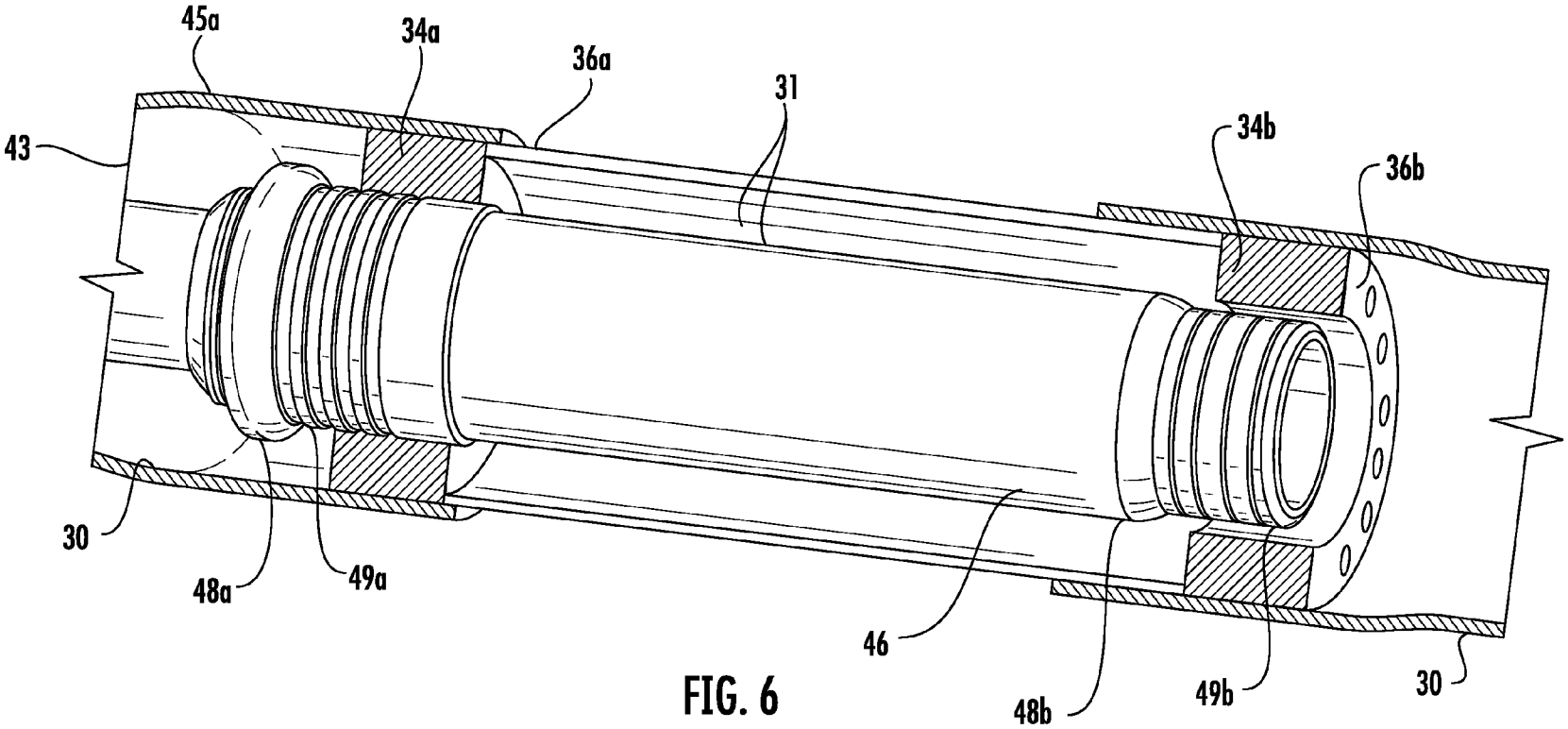
FIG. 6 is yet another partial cross-sectional view of a portion of the apparatus of FIG. 1.

Referring additionally to FIGS. 4-6, beginning at Block 82, the method includes positioning a tubular conductor 30 within the wellbore 24 (Block 84). The tubular conductor 30 may be slidably positioned through an intermediate casing 25, for example, in the subterranean formation 21 extending from the surface. The tubular conductor 30 may couple to the intermediate casing 25 via a thermal liner packer 26 or debris seal packer (DSP), for example. An expansion joint (not illustrated) may also be included. In particular, the intermediate casing 25 may be a TenarisHydril Wedge 563™ 13⅜" J55, or TN55TH, casing available from Tenaris S.A. of Luxembourg. The tubular conductor 30 may be a tubular liner, for example, a slotted or flush absolute cartridge system (FACS) liner. In particular, the tubular conductor 30 may be a TenarisHydril Wedge 532™ 10¾" stainless or carbon steel liner also available from Tenaris S.A. of Luxembourg. Of course either or both of the intermediate casing 25 and tubular conductor 30 may be another type of casing or conductor.

The tubular conductor 30 has a tubular dielectric section 31 therein so that the tubular conductor defines a dipole antenna. In other words, the tubular dielectric section 31 defines two tubular conductive segments 32*a*, 32*b* each defining a leg of the dipole antenna. Of course, other types of antennas may be defined by different or other arrangements of the tubular conductor 30. The tubular conductor 30 may also have a second dielectric section 35 therein defining a balun isolator or choke. The balun isolator 35 may be adjacent the thermal packer 26. Additional dielectric sections may be used to define additional baluns.

The tubular conductor 30 carries an electrical receptacle 33 therein. More particularly, the electrical receptacle 33 includes first and second electrical receptacle contacts 34*a*, 34*b* that electrically couple, respectively, to the two tubular conductive segments 32*a*, 32*b*. Each of the first and second electrical receptacle contacts 34*a*, 34*b* may have openings 36*a*, 36*b* therein, respectively, to permit the passage of fluids, as will be explained in further detail below.

At Block 86, the method includes slidably positioning a radio frequency (RF) transmission line 40 within the tubular conductor 30 so that a distal end 41 of the RF transmission line is electrically coupled to the tubular conductor. In particular, the RF transmission line 40 is illustratively a coaxial RF transmission line and includes an inner conductor 42 surrounded by an outer conductor 43. An end cap 51 couples to the inner conductor 42 and extends outwardly therefrom. The end cap 51 may be an extension of the second electrical receptacle contact 34*b*. The inner conductor 42 may be spaced apart from the outer conductor 43 by dielectric spacers 52. The dielectric spacers 52 may have openings 53 therein to permit the passage or flow of fluids, as will be explained in further detail below.

The RF transmission line 40 carries an electrical plug 44 at the distal end 41 to engage the electrical receptacle 33. More particularly, the electrical plug 44 includes first and second electrical plug contacts 45*a*, 45*b* electrically coupled to the inner and outer conductors 42, 43. The first and second electrical plug contacts 45*a*, 45*b* engage the first and second electrical receptacle contacts 34*a*, 34*b* of the electrical receptacle 33.

Each electrical plug contact 45*a*, 45*b* may include an electrically conductive body 48*a*, 48*b* and spring contacts 49*a*, 49*b* that may deform when compressed or coupled to the first and second electrical receptacle contacts 34*a*, 34*b*. Of course, other or additional types of electrical plugs 44 and/or coupling techniques may be used. The RF transmission line 40 at the distal end 41 may be spaced from the tubular conductor 30 by dielectric spacers 47, for example, bow spring centralizers.

At Block 88, the method includes supplying RF power, from an RF source 28 and via the RF transmission line 40, to the tubular conductor 30 so that the tubular conductor serves as an RF antenna to heat the hydrocarbon resources in the subterranean formation 21.

The method may include flowing a fluid through the tubular conductor 30 (Block 90). The fluid may include a dielectric fluid, a solvent, and/or a hydrocarbon resource. For example, the tubular conductor 30 and the RF transmission line 40 may be spaced apart to define a fluid passageway 55. A solvent may be flowed through the fluid passageway 55. In some embodiments, the solvent may be dispersed into the subterranean formation 21 through openings in the tubular conductor 30 adjacent the hydrocarbon resources.

In some embodiments, a fluid may be circulated through the RF transmission line 40. For example, the inner conductor 42 may be tubular defining a first fluid passageway 56, and the outer conductor 43 may be spaced apart from the inner conductor to define a second fluid passageway 57. A coolant, for example, may be passed through the first fluid passageway 56 from above the subterranean formation 21 to the RF antenna, and the coolant may be returned via the second fluid passageway 57. Of course, other fluids may be passed through the first and second fluid passageways 56, 57, and the fluid may not be circulated. In other embodiments, the fluid may be passed through other or additional annuli.

Figure 7:
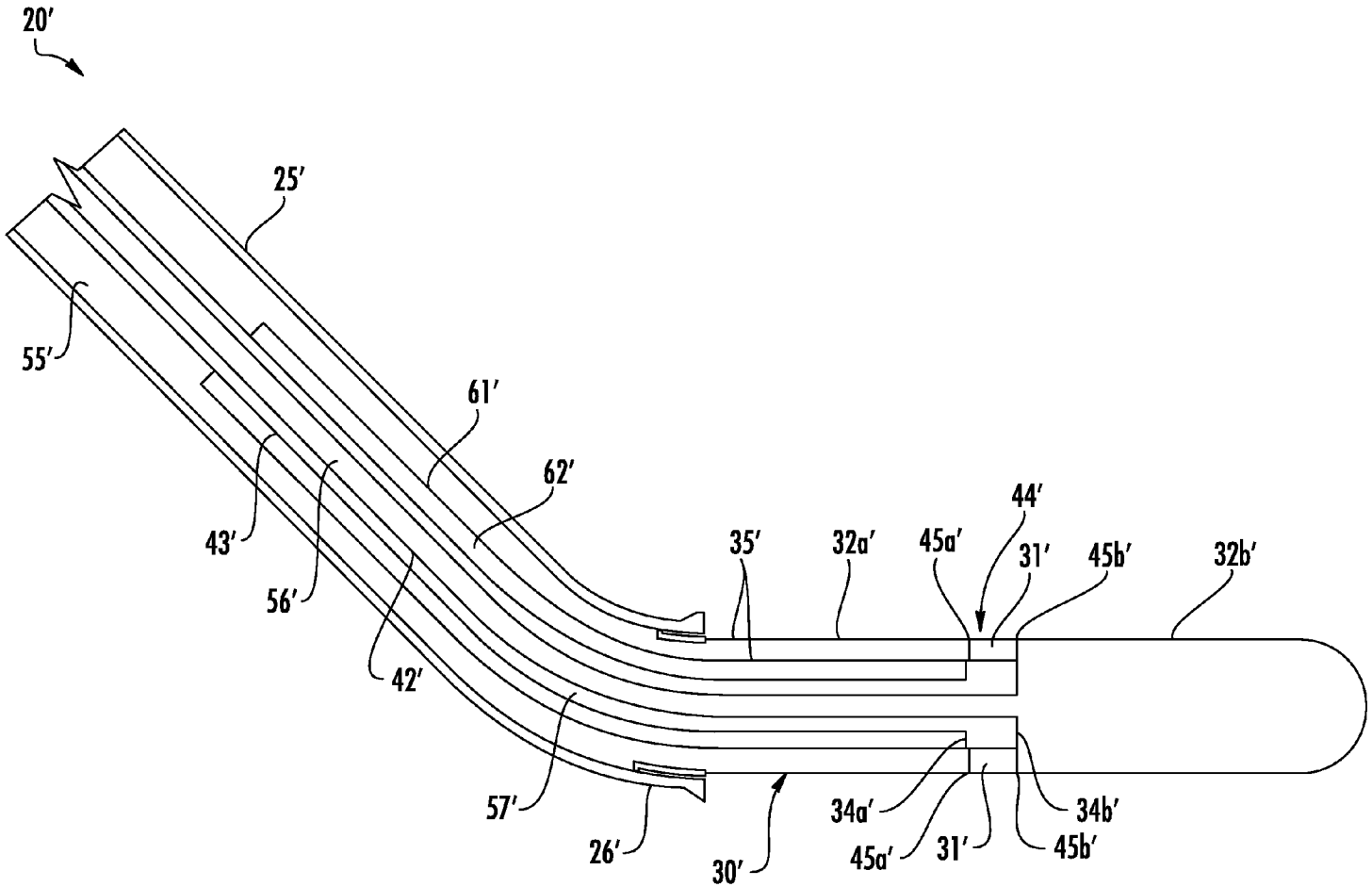
FIG. 7 is an enlarged schematic diagram of a portion of an apparatus in accordance with another embodiment of the present invention.

In other embodiments, for example, as illustrated in FIG. 7, an additional casing 61' or annuli, may surround the RF transmission line 40' and define a balun. The additional casing 61' may define a third fluid passageway 62', for example. In some embodiments, the third fluid passageway 62' may be filled with a balun fluid whose level may be adjusted, for example, to match resonate frequency of the balun to the resonate frequency of the RF antenna. For example, as the subterranean formation 21' changes, the frequency may be adjusted, and thus, also the balun. A pressure check valve may be used to return balun fluid via a fluid passageway designated for fluid return. Additional casings may be used to define additional baluns.

A temperature sensor 29 and/or a pressure sensor 27 may be positioned in the tubular conductor 30, or more particularly, coupled to the RF transmission line 40. The fluid may be flowed (Block 90) to control the temperature and/or pressure. Other or additional sensors may be positioned in the wellbore 24, and the fluid may be flowed to control other parameters.

After supplying RF power to heat the hydrocarbon resources, if, for example, the properties of subterranean formation 21 or RF antenna changed (i.e., impedance), the RF transmission line 40 may be slidably removed (Block 92). Of course, the RF transmission line 40 may be removed for any or other reasons.

If, for example, additional heating of the hydrocarbon resources is desired, the method may include slidably positioning another RF transmission line within the tubular conductor 30 so that a distal end of the another transmission line is electrically coupled to the tubular conductor (Block 94). The method ends at Block 96.

Indeed, the apparatus 20 may advantageously support multiple hydrocarbon resource processes, for example, injection of a gas or solvent while RF power is being supplied, producing or recovering hydrocarbon resources while applying RF power, and using a single wellbore for injection and production. Performing these functions, for example, without an additional wellbore, may provide increased cost savings, thus increasing efficiency.

Moreover, the apparatus 20 allows removal of the RF transmission line 40 from the wellbore 24, and common mode suppression, thus resulting in further cost savings. Also, the RF transmission line impedance may be adjusted during use, which may result in even further cost savings and increased efficiency. For example, at startup (1-2 years) a 50-Ohm RF transmission line may be used. For long term operation (e.g. after 2 years), a 25-30 Ohm RF transmission line may be used.

Referring now to FIGS. 8-13, an apparatus 120 is now described for heating hydrocarbon resources in a subterranean formation 121 having a wellbore 124 therein. The apparatus 120 includes a tubular radio frequency (RF) antenna 130 within the wellbore. The tubular RF antenna 130 may be slidably positioned through an intermediate casing 125, for example, in the subterranean formation 121 extending from the surface. The tubular RF antenna 130 may couple to the intermediate casing 125 via a thermal liner packer 126 or debris seal packer (DSP), for example. The intermediate casing 125 and the tubular RF antenna 130 may each be of the respective type described above. Of course either or both of the intermediate casing 125 and tubular RF antenna 130 may be another type of casing or conductor.

The tubular RF antenna 130 includes first and second sections 132*a*, 132*b* and an insulator 131 or dielectric therebetween. As will be appreciated by those skilled in the art, the RF antenna 130 defines a dipole antenna. In other words, the first and second sections 132*a*, 132*b* each define a leg of the dipole antenna. Of course, other types of antennas may be defined by different or other arrangements of the RF antenna 130. In some embodiments (not shown), the RF antenna 130 may also have a second insulator therein.

A tool 150 is slidably positioned within the tubular RF antenna 130 and includes an RF transmission line 140, and RF contacts 145*a*, 145*b* coupled to a distal end 141 of the RF transmission line. The RF transmission line 140 is illustratively a coaxial RF transmission line and includes an inner conductor 142 surrounded by an outer conductor 143.

The RF contacts 145*a*, 145*b* are biased in contact with the tubular RF antenna 130. More particularly, the RF contacts 145*a*, 145*b* include a first set of RF contacts 145*a* that are coupled to the outer conductor 143 and biased in contact with an adjacent inner surface of the first conductive section 132*a*. A second set of RF contact 145*b* is coupled to the inner conductor 142 and biased in contact with an adjacent inner surface of the second conductive section 132*b*. A dielectric section 154 is between the first and second sets of RF contacts 145*a*, 145*b*. The dielectric section 154 may be quartz or cyanate quartz, for example. Of course, the dielectric section 154 may be other or additional materials.

The RF contacts 145*a*, 145*b* are each illustratively a conductive wound spring having a generally rectangular shape, such as, for example, a watchband spring. One exemplary watchband spring may be the 901 Series Watchband available from Myat, Inc. of Mahwah, N.J. Of course, the RF contacts may have another shape. The RF contacts 145*a*, 145*b* may be a metal, for example, and may be "like metals," as this may mitigate corrosion, even in the presence of electrolytes. For redundancy, four watchband springs may be used, and for increased electrical connectivity, each watchband spring may be beryllium copper. Of course, any number of watchband springs may be used and each may include other and/or additional materials.

A zinc alloy anode 171 is illustratively positioned on opposite sides of each of the first and second set of RF contacts 145*a*, 145*b*. In particular, the zinc alloy anodes 171 are positioned between the transition between the tubular RF antenna 130, which may be steel, and the tool 150, which may include copper. This transition or interface is generally a concern for corrosion, as will be appreciated by those skilled in the art.

Additionally, a stack of spiral V-rings 172 (e.g. including at least 3 spiral V-rings) may be positioned outside each of the zinc alloy anodes 171. The stack of spiral V-rings 172 may be aromatic polyester filled PTFE (Ekonol) rated for −157° C. to 285° C., for example, and are configured to isolate reservoir fluids from the RF contacts 145*a*, 145*b*. Of course, the spiral V-rings 172 may be a different material or another type of sealing device or ring. A respective bottom and top adapter 173*a*, 173*b* surround each V-ring stack 172. The bottom adapter 173*a* may be glass filled PEEK (W4686) having a temperature rating of −54° C. to 260° C., and the top adapter 173*b* may be glass filled PTFE (P1250) having a temperature rating of −129° C. to 302° C. The bottom and top adapters 173*a*, 173*b* may each be a different material.

Figure 14:
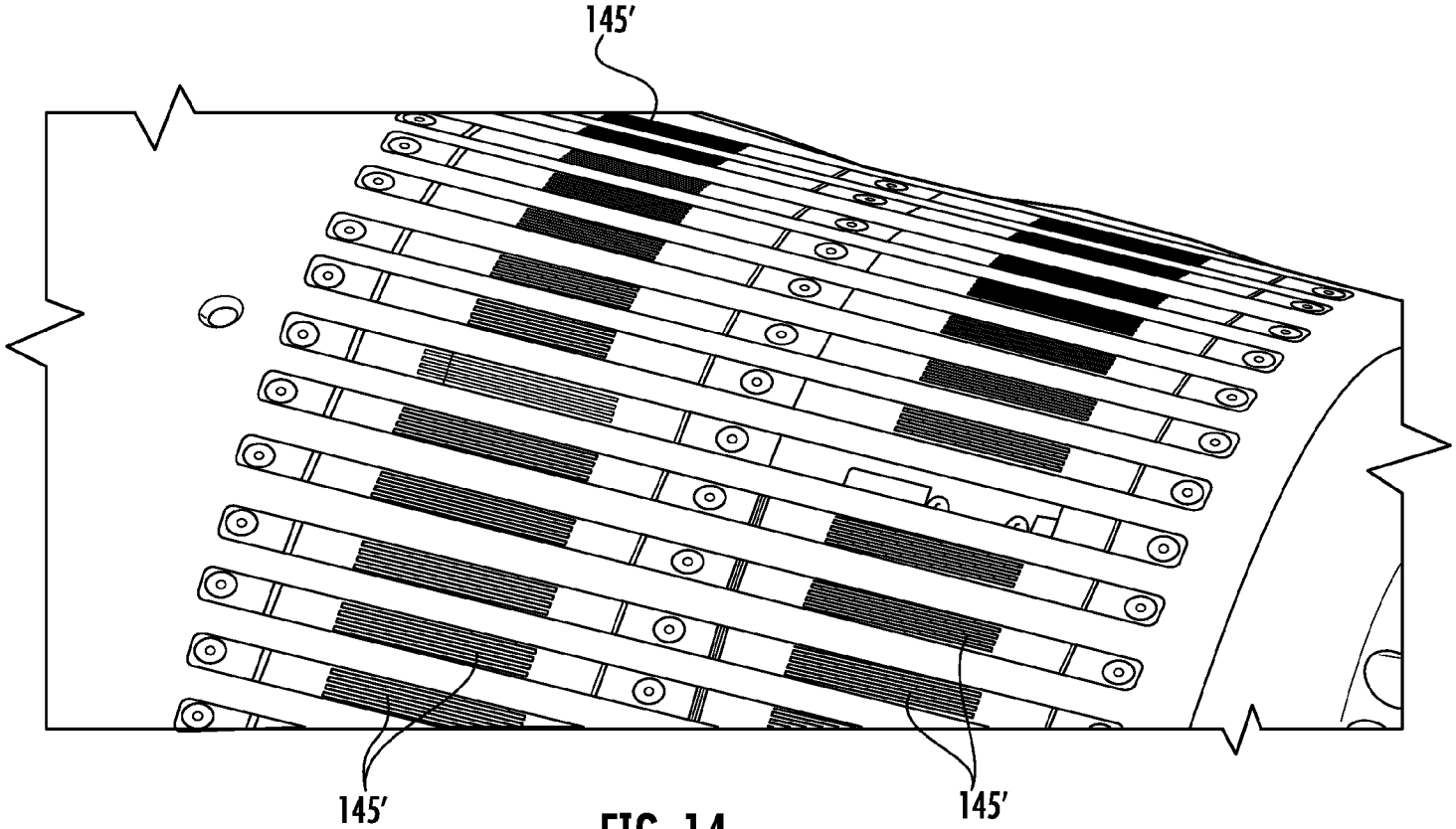
FIG. 14 is a schematic diagram of a portion of a set of RF contacts in accordance with another embodiment of the present invention.
Figure 15:
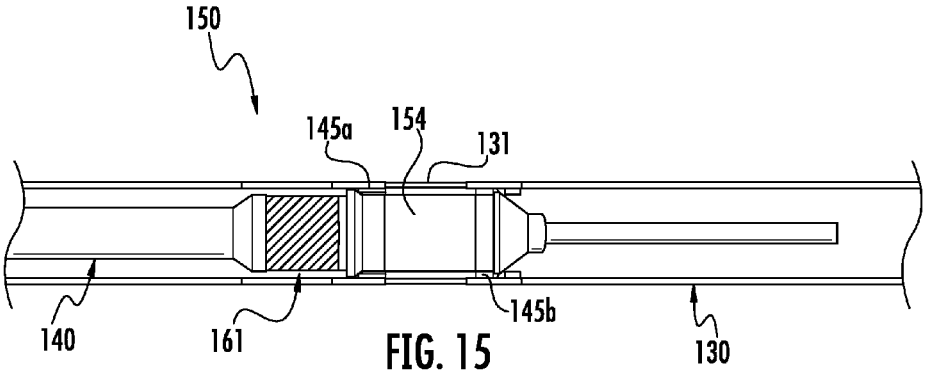
FIG. 15 is a schematic diagram of the tool including an anchoring device in a retracted position in accordance with an embodiment of the present invention.
Figure 16:
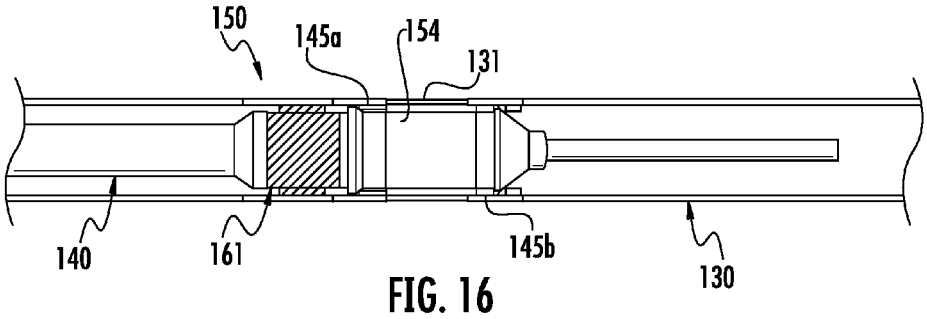
FIG. 16 is another schematic diagram of the tool in FIG. 15 with the anchoring device in the extended position.
Figure 17:
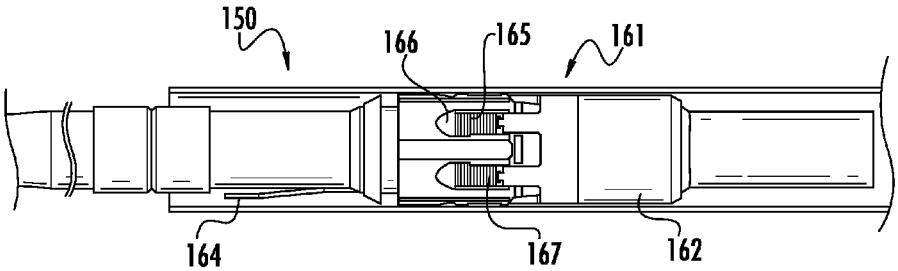
FIG. 17 is a more detailed schematic diagram of the anchoring device of the tool in accordance with the present invention.
Figure 18:
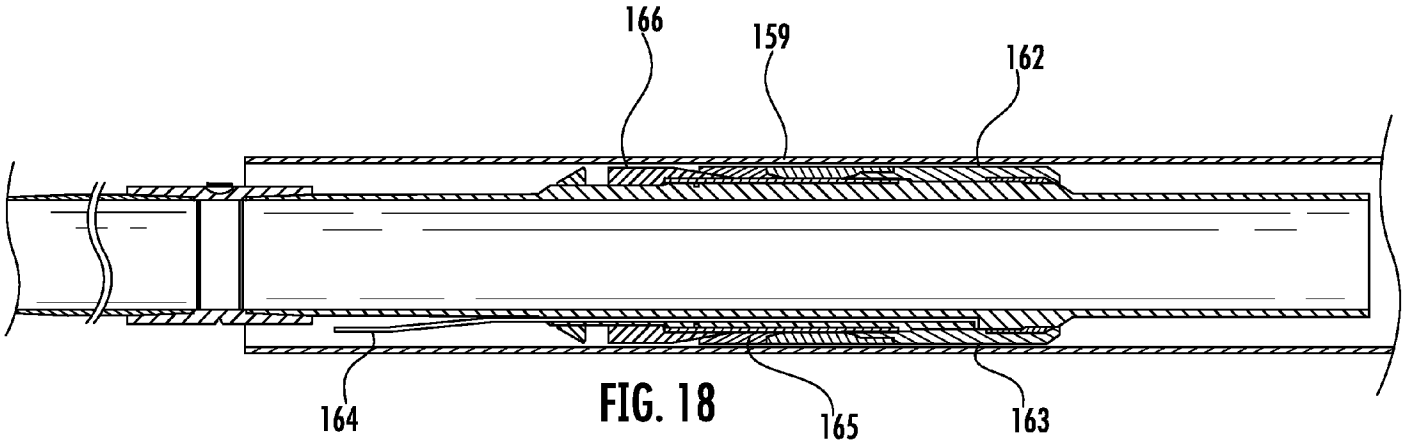
FIG. 18 is a schematic cross-sectional view of the anchoring device in FIG. 17 prior to anchoring.
Figure 19:
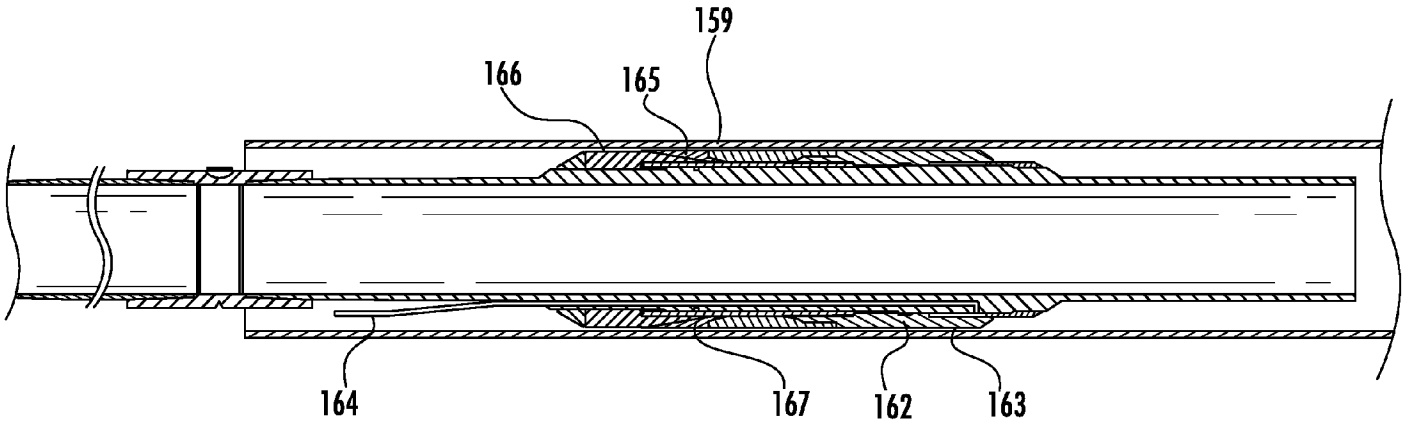
FIG. 19 is a schematic cross-sectional view of the anchoring device in FIG. 18 after anchoring.

Referring briefly to FIG. 14, in another embodiment, each of the RF contacts 145' may be in the form of a deployable contact that is moveable between a retracted position and a deployed position. As will be appreciated by those skilled in the art, the deployable RF contacts 145' may be hydraulically operated RF contacts and moved between the retracted and the deployed positions hydraulically. Of course, in other embodiments, other types of RF contacts may be used.

Referring again to FIGS. 8-13, and additionally to FIGS. 15-19, an outer tube 159 surrounds the RF transmission line 140 (FIG. 12). As will be appreciated by those skilled in the art, the outer tube 159 may permit the passage of fluids therethrough, for example, hydrocarbon resources or coolant.

The tool 150 also includes an anchoring device 161 carried by the outer tube 159 and configured to selectively anchor the RF transmission line 140 and the RF contacts 145 within the tubular RF antenna 130. The anchoring device 161 includes a radially moveable body 162 and a hydraulically activated piston 163 coupled to the radially moveable body. More particularly, a hydraulic feed line 164 is coupled to the hydraulically activated piston 163. The anchoring device 161 also includes radially spaced locking slips 165 cooperating with corresponding skids 166.

Operation of the anchoring device 161 will now be described. As pressure is applied to the tool 150 in the downhole direction, rails on the skids 166 pull a corresponding locking slip 165 downwardly. A shear device 167, for example, in the form of one or more pins, screws, etc., associated with the locking slips 165 is sheared at about 500 psi, for example, to activate the locking slips. The locking slips 165 are fully set at about 1500 psi, for example. A second shear device (not shown), which may also be in the form of one or more pins, screws, etc., breaks at about 40,000 Lbs of tension, for example. The shear device 167 may be sheared, and the locking slips 165 may be fully set at different pressures. The second shear device may also break at a different tension. The hydraulically activated piston 163 is activated causing the radially moveable body 162 to move radially outwardly. The anchoring device 161 may be another type of anchoring device, or may additional types of anchoring devices that selectively anchor the RF transmission line 140 and the RF contacts 145*a*, 145*b* to the tubular RF antenna 140. Of course, the anchoring device 161 may be deactivated to permit removal of the tool 150.

Figure 8:
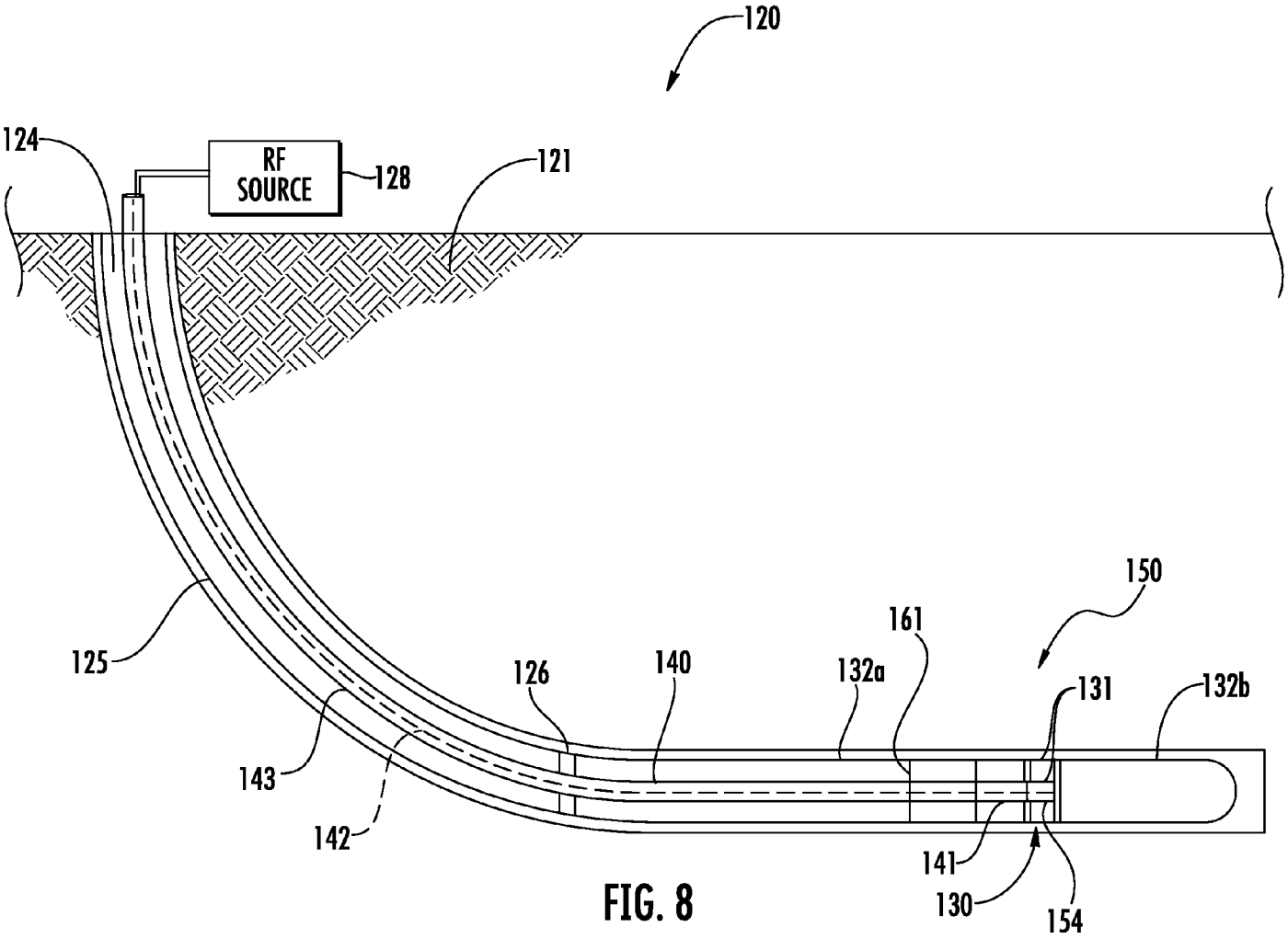
FIG. 8 is a schematic diagram of a subterranean formation including an apparatus in accordance with another embodiment of the present invention.
Figure 9:
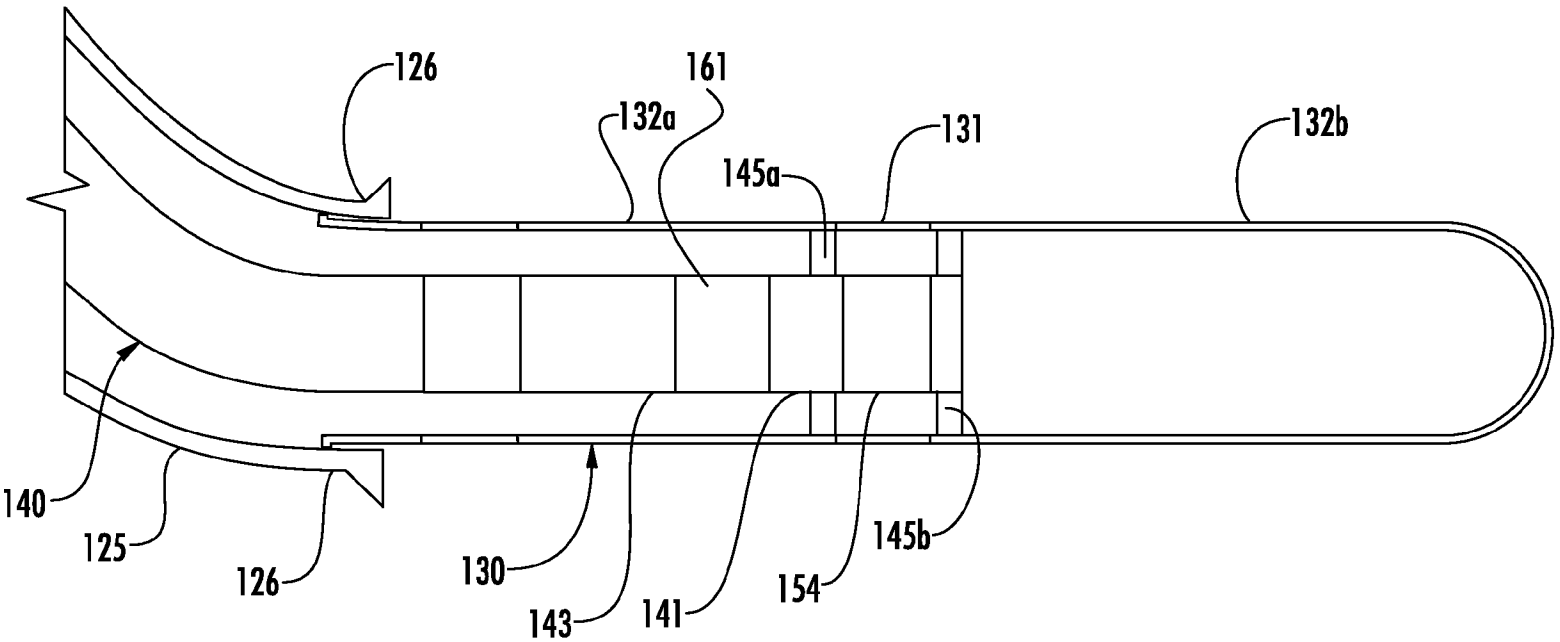
FIG. 9 is an enlarged schematic diagram of a portion of the apparatus of FIG. 8.
Figure 10:
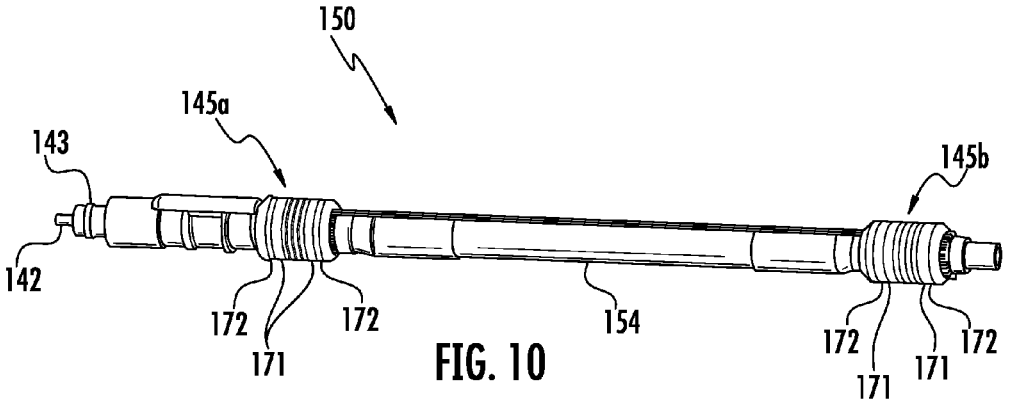
FIG. 10 is a schematic diagram a portion of the tool and inner and outer conductors of the apparatus of FIG. 9.
Figure 11:
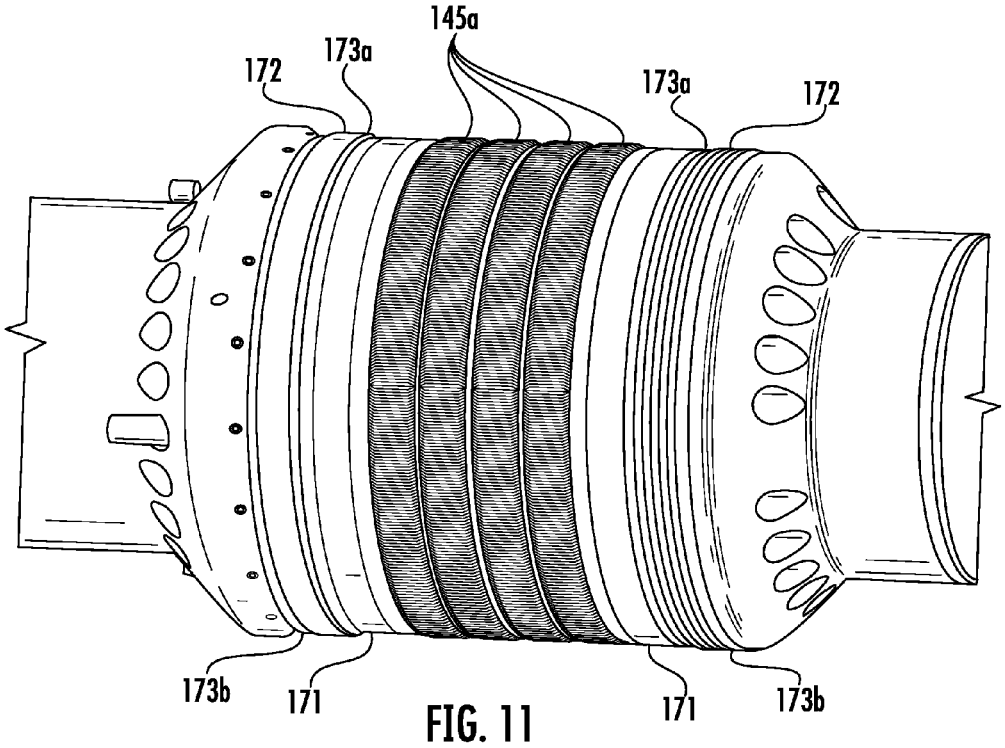
FIG. 11 is an enlarged schematic diagram of a first set of RF contacts of the tool of FIG. 10.
Figure 12:
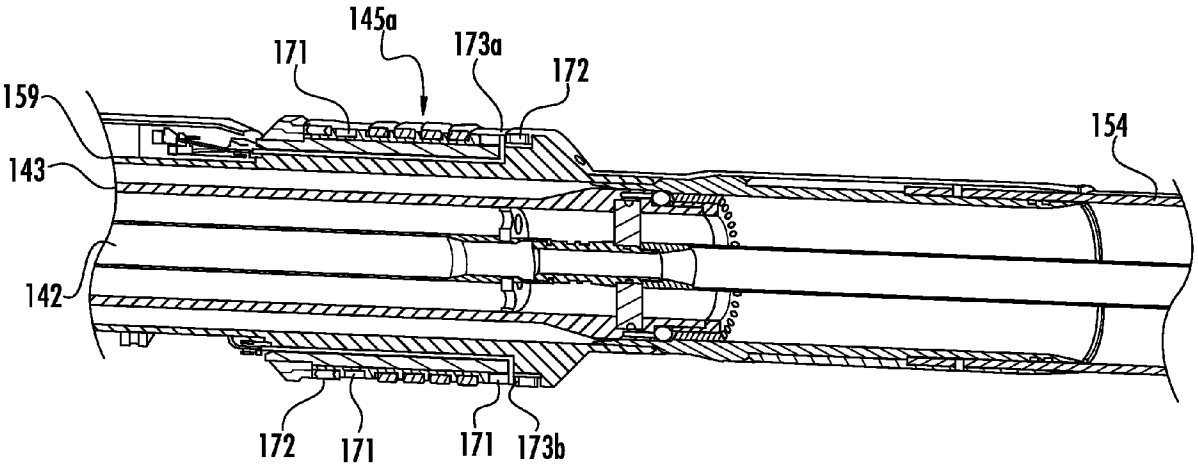
FIG. 12 is a schematic cross-sectional view of the first set of RF contacts of the tool of FIG. 10.
Figure 13:
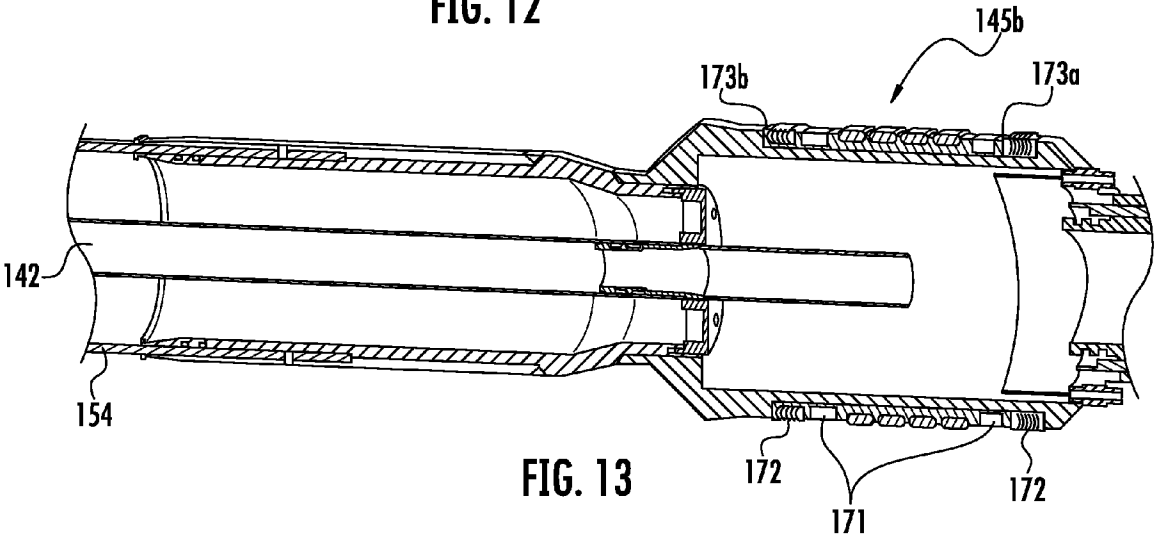
FIG. 13 is a schematic cross-sectional view of the second set of RF contacts of the tool of FIG. 10.

An RF source 128 supplies RF power via the RF transmission line 140, to the tubular RF antenna 130 so that the tubular RF antenna heats the hydrocarbon resources in the subterranean formation 121 (FIG. 8).

Figure 20:
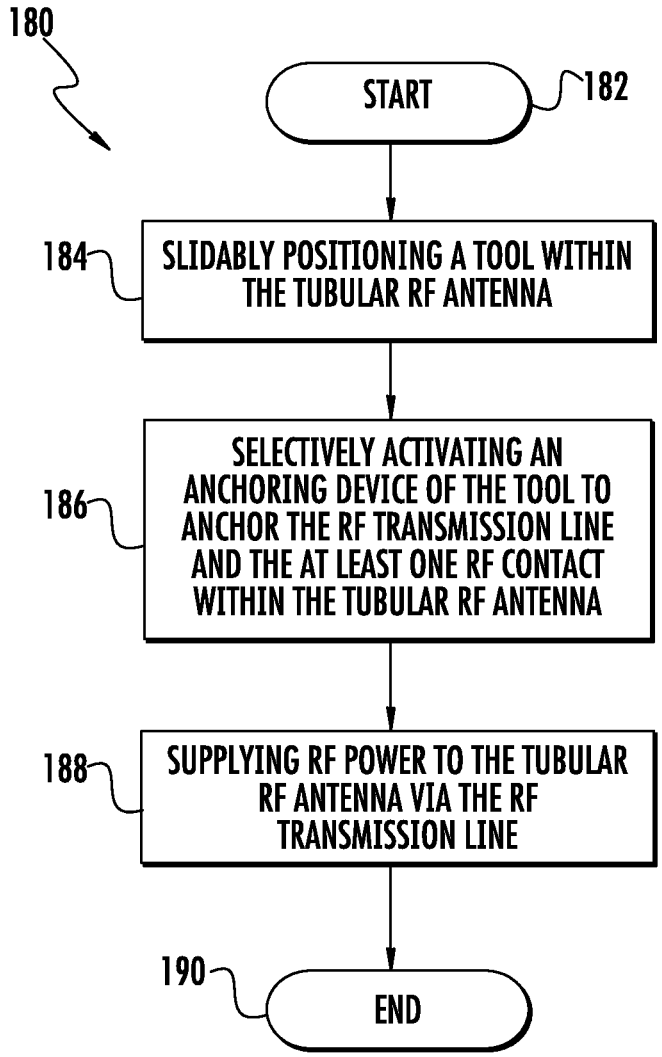
FIG. 20 is a flow diagram of a method of heating hydrocarbon resource in accordance with an embodiment of the present invention.

Referring now to the flowchart 180 in FIG. 20, beginning at Block 182 a method aspect is directed to a method for heating hydrocarbon resources in a subterranean formation 121 having a wellbore 124 therein with a tubular RF antenna 130 within the wellbore. At Block 184 the method includes slidably positioning a tool 150 within the tubular RF antenna 130. The tool 150 includes an RF transmission line 140 and at least one RF contact 145*a*, 145*b* coupled to a distal end 141 of the RF transmission line and that is biased in contact with the tubular RF antenna 130. The method also includes, at Block 186, selectively activating an anchoring device 161 of the tool 150 to anchor the RF transmission line 140 and the at least one RF contact 145*a*, 145*b* within the tubular RF antenna 130. The method further includes supplying RF power to the tubular RF antenna 130 via the RF transmission line 140 (Block 188). The method ends at Block 190.

Referring now to FIGS. 21-26, an apparatus 220 for heating hydrocarbon resources in a subterranean formation 221 having a wellbore 224 therein according to another embodiment is now described. The apparatus 220 includes a tubular radio frequency (RF) antenna 230 within the wellbore 224. The tubular RF antenna 230 may couple to an intermediate casing 225 via a thermal liner packer 226 or debris seal packer (DSP), for example, and may be of the type described above. Of course either or both of the intermediate casing 225 and tubular RF antenna 230 may be another type of casing or conductor.

The RF antenna 230 includes first and second sections 232*a*, 232*b* and an insulator 231 or dielectric therebetween. As will be appreciated by those skilled in the art, the RF antenna 230 defines a dipole antenna. In other words, the first and second sections 232*a*, 232*b* each define a leg of the dipole antenna. Of course, other types of antennas may be defined by different or other arrangements of the RF antenna 230. In some embodiments (not shown), the RF antenna 230 may also have a second insulator therein.

A tool 250 is slidably positioned within the tubular RF antenna 230 and includes an RF transmission line 240, and RF contacts 245*a*, 245*b* coupled to a distal end 241 of the RF transmission line. The RF transmission line 240 is illustratively a coaxial RF transmission line and includes an inner conductor 242 surrounded by an outer conductor 243.

The RF contacts 245*a*, 245*b* are biased in contact with the tubular RF antenna 230. More particularly, the RF contacts 245*a*, 245*b* include a first set of RF contacts 245*a* that are coupled to the outer conductor 243 and biased in contact with an adjacent inner surface of the first conductive section 232*a*. A second set of RF contact 245*b* is coupled to the inner conductor 242 and biased in contact with an adjacent inner surface of the second conductive section 232*b*. A dielectric section 254 is between the first and second sets of RF contacts 245*a*, 245*b*. The dielectric section 254 may be quartz or cyanate quartz, for example. Of course, the dielectric section 254 may be other or additional materials.

The RF contacts 245*a*, 245*b* are each illustratively a conductive wound spring having a generally rectangular shape, such as, for example a watchband spring of the type described above. Of course, the RF contacts 245*a*, 245*b* may have another shape. The RF contacts 245*a*, 245*b* may be a metal, for example, and may be "like metals," as this may mitigate corrosion, even in the presence of electrolytes. For redundancy, four watchband springs may be used, and for increased electrical connectivity, each watchband spring may be beryllium copper. Of course, any number of watchband springs may be used and each may include other and/or additional materials.

A zinc alloy anode 271 is illustratively positioned on opposite sides of each of the first and second set of RF contacts 245*a*, 245*b*. In particular, the zinc alloy anodes 271 are positioned between the transition between the tubular RF antenna 230, which may be steel, and the tool 250, which may include copper. This transition or interface is generally a concern for corrosion, as will be appreciated by those skilled in the art.

Additionally, a stack of spiral V-rings 272 (e.g. including at least 3 spiral V-rings) may be positioned outside each of the zinc alloy anodes 271. The stack of spiral V-rings 272 may be aromatic polyester filled PTFE (Ekonol) rated for −157° C. to 285° C., for example, and are configured to isolate reservoir fluids from the RF contacts 245*a*, 245*b*. Of course, the spiral V-rings 272 may be a different material or another type of sealing device or ring. A respective bottom and top adapter 273*a*, 273*b* surround each V-ring stack 272. The bottom adapter 273*a* may be glass filled PEEK (W4686) having a temperature rating of −54° C. to 260° C., and the top adapter 273*b* may be glass filled PTFE (P1250) having a temperature rating of −129° C. to 302° C. The bottom and top adapters 273*a*, 273*b* may each be a different material.

Figure 27:
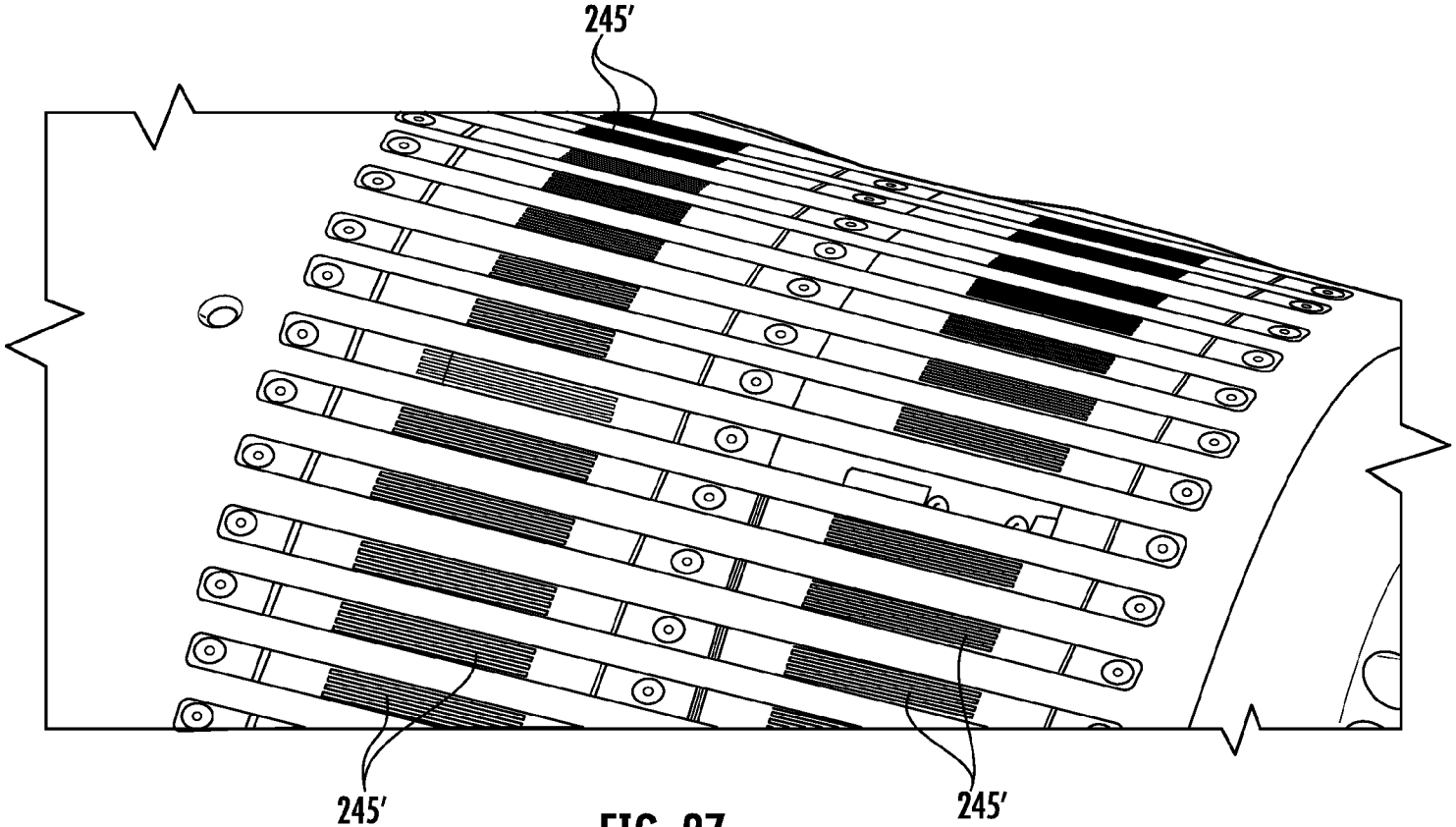
FIG. 27 is a schematic diagram of a portion of a set of RF contacts in accordance with another embodiment of the present invention.
Figure 28:
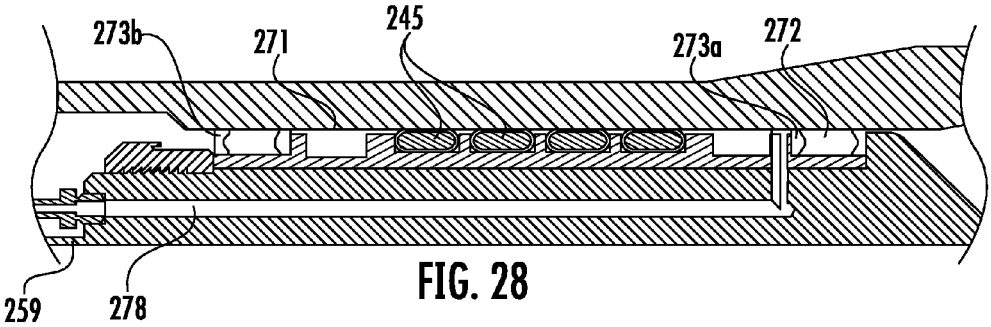
FIG. 28 is a schematic cross-sectional view of a portion of the tool including a portion of a dielectric grease injector in accordance with the present invention.
Figure 29:
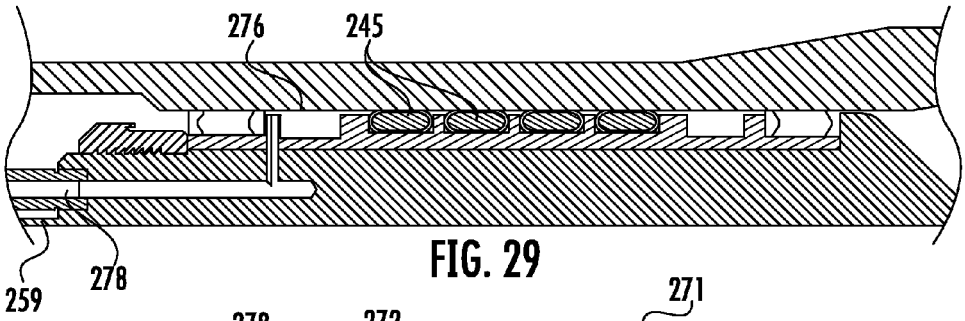
FIG. 29 is another schematic cross-sectional view of the portion of the tool including a portion of a dielectric grease injector in accordance with the present invention.

Referring briefly to FIG. 27, in another embodiment, each of the RF contacts 245' may be in the form of a deployable contact that is moveable between a retracted position and a deployed position. As will be appreciated by those skilled in the art, the deployable RF contacts 245' may be hydraulically operated RF contacts and moved between the retracted and the deployed positions hydraulically. Of course, in other embodiments, other types of RF contacts may be used.

Referring again to FIGS. 21-26 and additionally to FIGS. 28-34, an outer tube 259 surrounds the RF transmission line 240. The tool 250 also includes a plurality of dielectric grease injectors 275 configured to inject dielectric grease around the RF contacts 245*a*, 245*b*. The stacks of spiral V-rings 272 along with the bottom and top adapters 273*a*, 273*b* define a contact grease chamber 276. Illustratively, the dielectric grease injector 275 includes at a hydraulically operable dielectric grease syringe 277 and associated tubing 278 coupled in fluid communication with the contact grease chamber 276. The tubing 278 may be coupled to the upstream hydraulic line that is used to supply other portions of the tool, for example, the anchoring device described in detail above. As grease is pumped into the grease chamber 276, undesired materials, such as, for example, diesel, bitumen, and water, may be forced out of the grease chamber. Exemplary grease may be PTFE grease, for example. Of course, other types of greases may be used, and viscosity may vary between a relatively flowable liquid up to a gel as will be appreciated by those skilled in the art.

Figure 25:
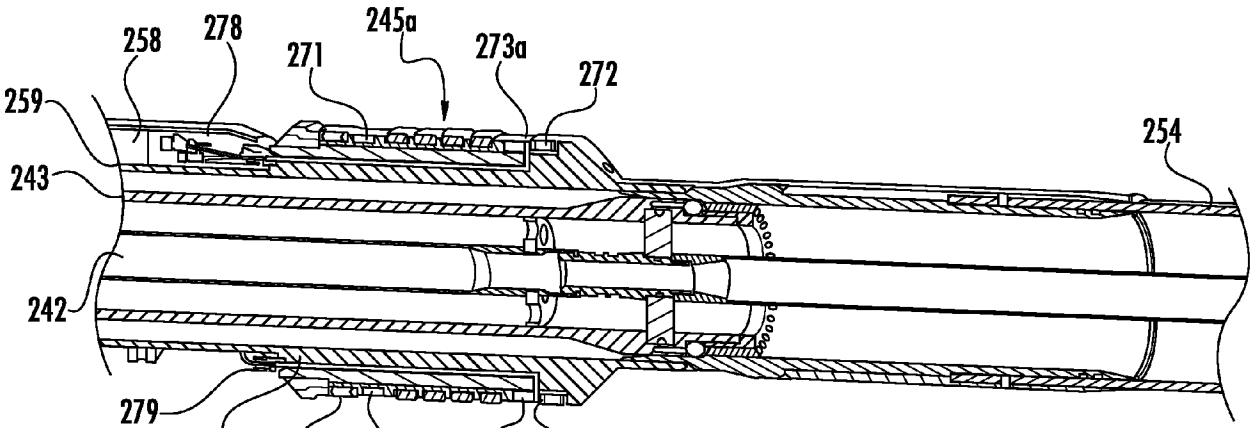
FIG. 25 is a schematic cross-sectional view of the first set of RF contacts of the tool of FIG. 23.
Figure 26:
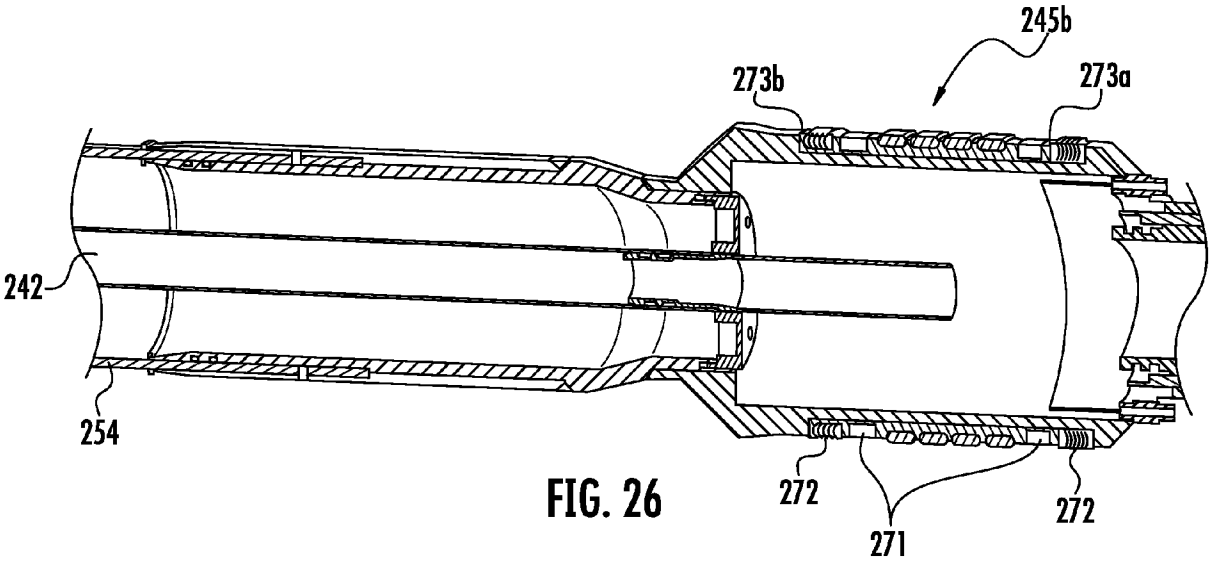
FIG. 26 is a schematic cross-sectional view of the second set of RF contacts of the tool of FIG. 23.
Figure 30:
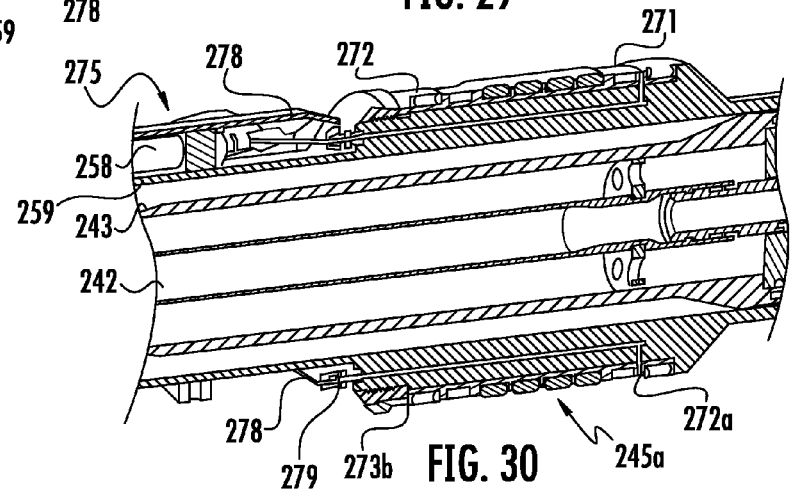
FIG. 30 is a more detailed schematic cross-sectional view of a portion of the tool of including the dielectric grease injector in accordance with the present invention.
Figure 31:
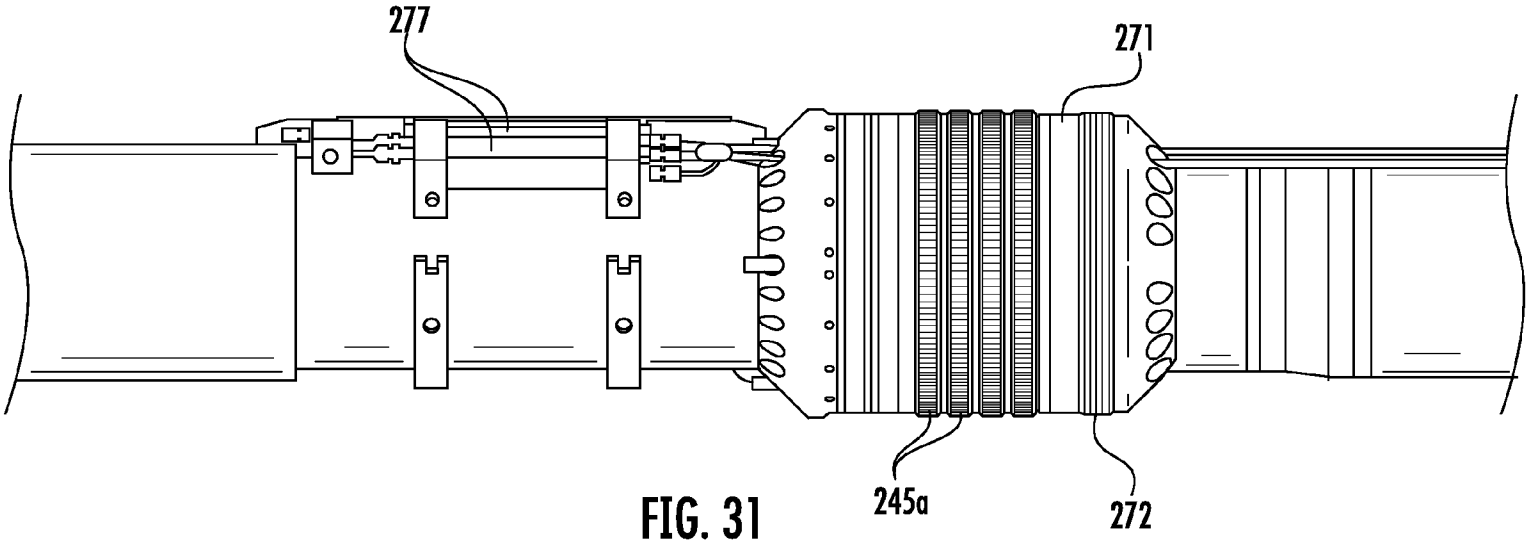
FIG. 31 is a more detailed schematic plan view of a larger portion of the tool in FIG. 30.
Figure 32:
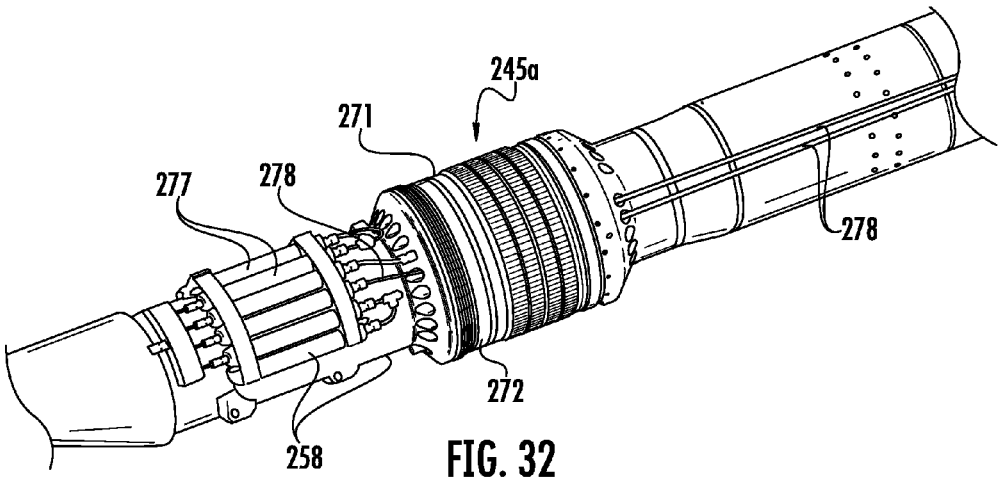
FIG. 32 is more detailed schematic perspective view of the tool of FIG. 31.
Figure 33:
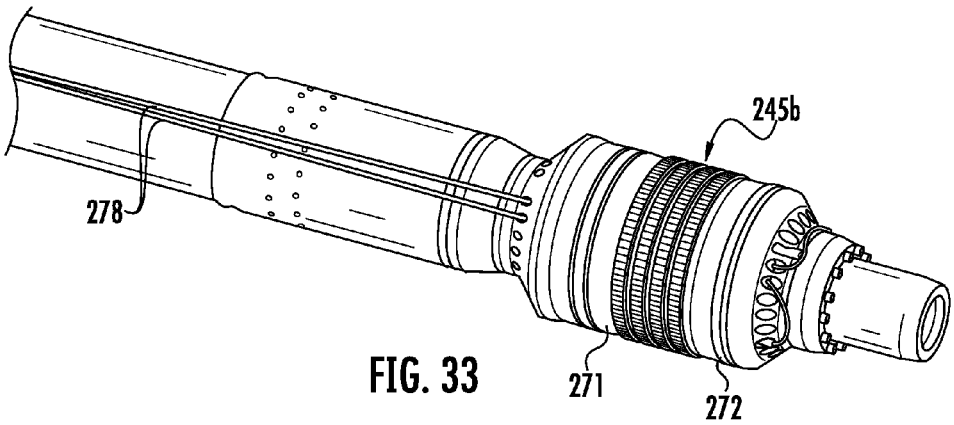
FIG. 33 is another schematic perspective view of another portion of the tool including portions of the dielectric grease injector in accordance with the present invention.

The tool 250 also includes a check valve 279 in fluid communication with the contact grease chamber 276 (FIGS. 25 and 30). The check valve 279 may advantageously ensure grease flow in the desired direction while preventing the undesired materials noted above from reentering the grease chamber 276. The check valve 279 may be an SS-4CP2-KZ-5 check valve available from the Swagelok Company of Solon, Ohio operating at 5 psi. Of course, other check valves may be used, for example from Conax Technologies of Buffalo, N.Y., and more than one check valve may be used. In some embodiments, the check valve O-ring may be replaced with a fluoropolymer (e.g., a perfluorinated elastomer) O-ring for higher temperature service.

The tool also includes an accumulator 258 coupled in fluid communication with the contact grease chamber 276. As will be appreciated by those skilled in the art, the accumulator 258 may accumulate or collect grease from the contact grease chamber 276 when there is a pressure change. In other words, if, for example, there is an increase in temperature that causes the pressure to increase, the accumulator 258 may collect or provide additional volume for the grease.

Figure 21:
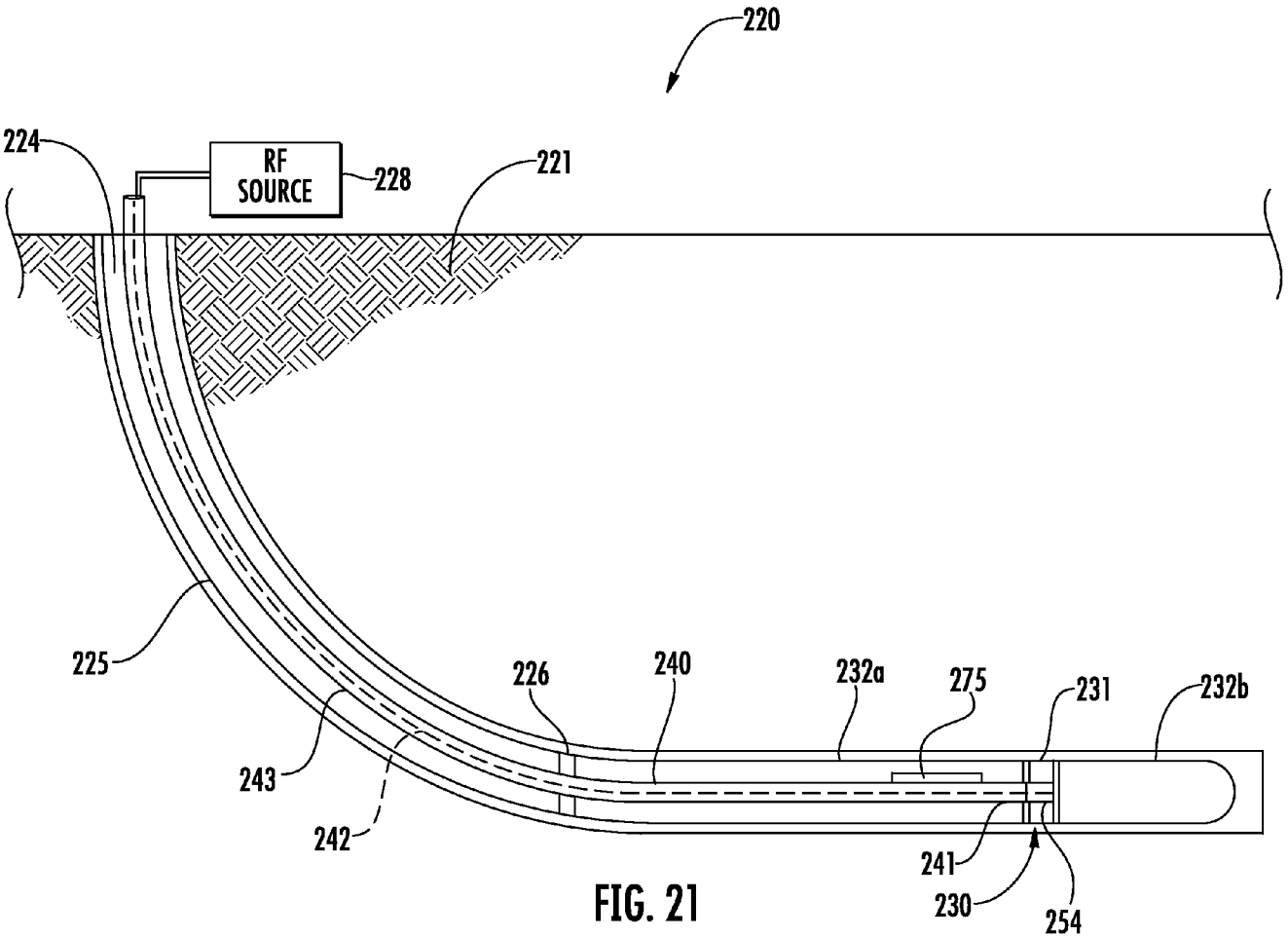
FIG. 21 is a schematic diagram of a subterranean formation including an apparatus in accordance with another embodiment of the present invention.
Figure 22:
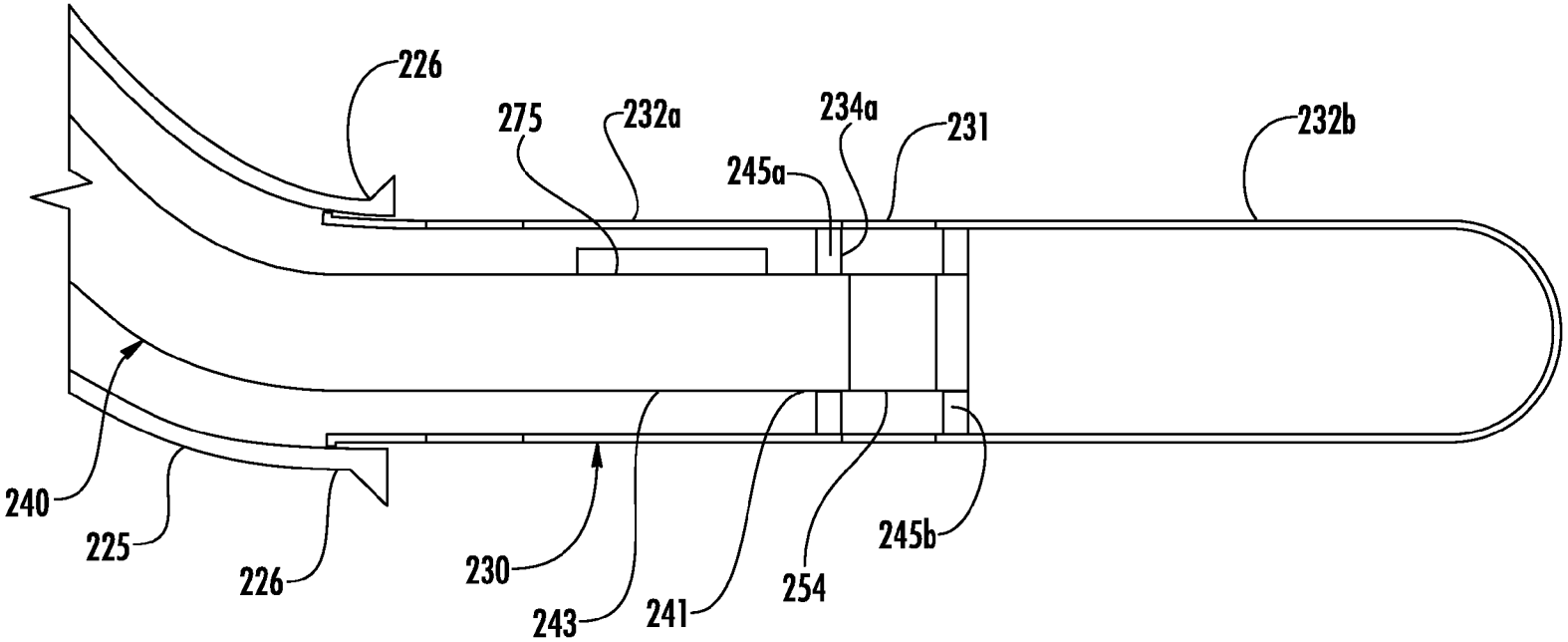
FIG. 22 is an enlarged schematic diagram of a portion of the apparatus of FIG. 21.
Figure 23:
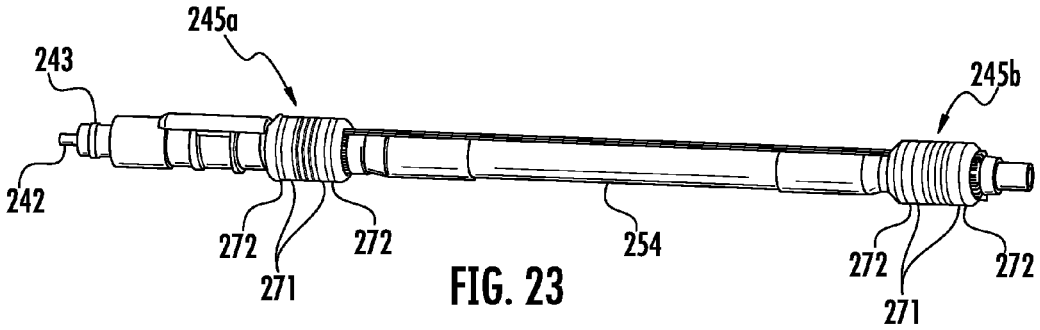
FIG. 23 is a schematic diagram a portion of the tool and inner and outer conductors of the apparatus of FIG. 22.
Figure 24:
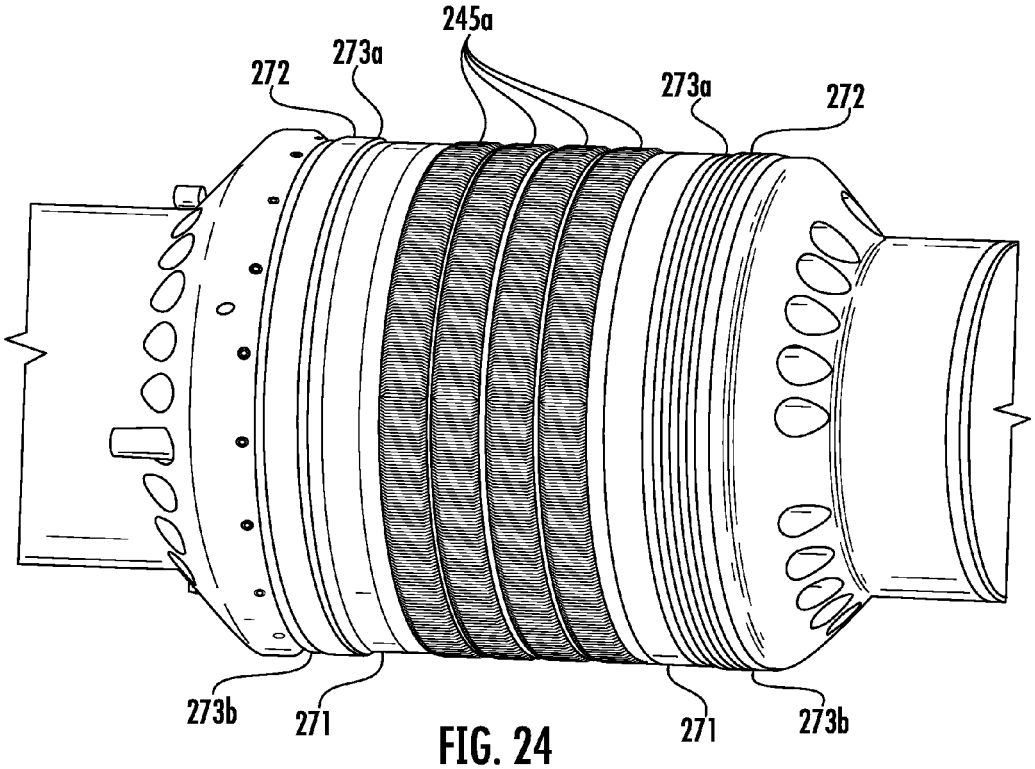
FIG. 24 is an enlarged schematic diagram of a first set of RF contacts of the tool of FIG. 23.

An RF source 228 supplies RF power via the RF transmission line 240, to the tubular RF antenna 230 so that the tubular RF antenna heats the hydrocarbon resources in the subterranean formation 221 (FIG. 21).

Figure 34:
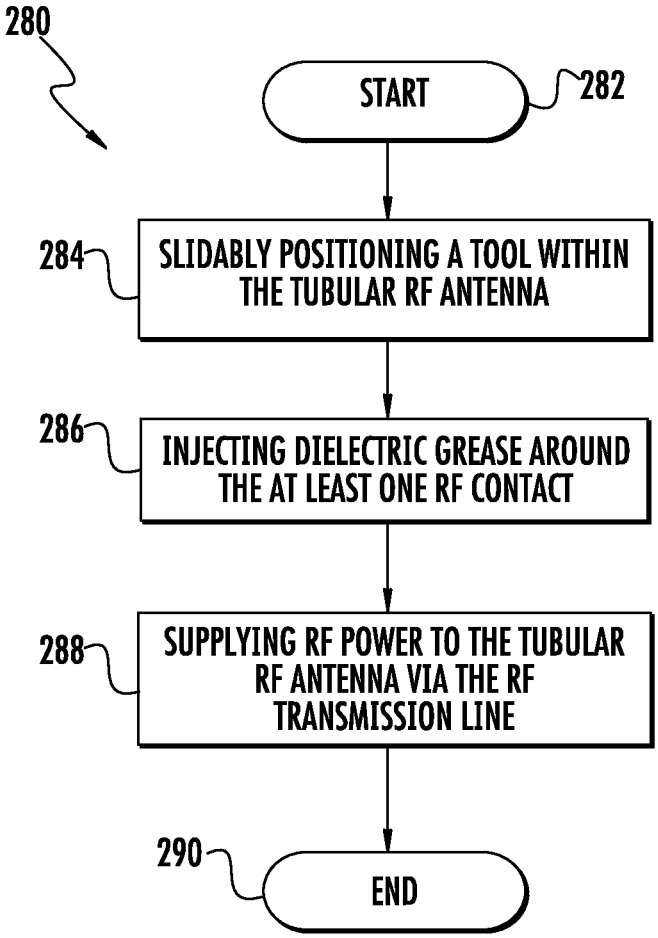
FIG. 34 is a flow diagram of a method of heating hydrocarbon resource in accordance with an embodiment of the present invention.

Referring now to the flowchart 280 in FIG. 34, beginning at Block 282 a method aspect is directed to a method for heating hydrocarbon resources in a subterranean formation 221 having a wellbore 224 therein with a tubular RF antenna 230 within the wellbore. At Block 284 the method includes slidably positioning a tool 250 within the tubular RF antenna 230. The tool 250 includes an RF transmission line 240 and at least one RF contact 245*a*, 245*b* coupled to a distal end 241 of the RF transmission line and that is biased in contact with the tubular RF antenna 230. The method also includes, at Block 286, injecting dielectric grease around the at least one RF contact 245*a*, 245*b*, and supplying RF power to the tubular RF antenna 230 via the RF transmission line 240 (Block 288). The method ends at Block 290.

Referring now to FIGS. 35-40, another apparatus 330 for heating hydrocarbon resources in a subterranean formation 321 having a wellbore 322 therein is now described. The apparatus 320 includes a tubular radio frequency (RF) antenna 330 within the wellbore 322. The tubular RF antenna 330 may couple to an intermediate casing 325 via a thermal liner packer 326 or debris seal packer (DSP), for example, and may be of the type described above. Of course either or both of the intermediate casing 325 and tubular RF antenna 330 may be another type of casing or conductor.

The RF antenna 330 includes first and second sections 332*a*, 332*b* and an insulator 331 or dielectric therebetween. As will be appreciated by those skilled in the art, the RF antenna 330 defines a dipole antenna. In other words, the first and second sections 332*a*, 332*b* each define a leg of the dipole antenna. Of course, other types of antennas may be defined by different or other arrangements of the RF antenna 330. In some embodiments (not shown), the RF antenna 330 may also have a second insulator therein.

A tool 350 is slidably positioned within the tubular RF antenna 330 and includes an RF transmission line 340, and RF contacts 345*a*, 345*b* coupled to a distal end 341 of the RF transmission line. The RF transmission line 340 is illustratively a coaxial RF transmission line and includes an inner conductor 342 surrounded by an outer conductor 343.

The RF contacts 345*a*, 345*b* are biased in contact with the tubular RF antenna 330. More particularly, the RF contacts 345*a*, 345*b* include a first set of RF contacts 345*a* that are coupled to the outer conductor 343 and biased in contact with an adjacent inner surface of the first conductive section 332*a*. A second set of RF contact 345*b* is coupled to the inner conductor 342 and biased in contact with an adjacent inner surface of the second conductive section 332*b*. A dielectric section 354 is between the first and second sets of RF contacts 345*a*, 345*b*. The dielectric section 354 may be quartz or cyanate quartz, for example. Of course, the dielectric section 354 may be other or additional materials.

The RF contacts 345*a*, 345*b* are each illustratively a conductive wound spring having a generally rectangular shape, such as, for example a watchband spring of the type described above. Of course, the RF contacts 345*a*, 345*b* may have another shape. The RF contacts 345*a*, 345*b* may be a metal, for example, and may be "like metals," as this may mitigate corrosion, even in the presence of electrolytes. For redundancy, four watchband springs may be used, and for increased electrical connectivity, each watchband spring may be beryllium copper. Of course, any number of watchband springs may be used and each may include other and/or additional materials.

A zinc alloy anode 371 is illustratively positioned on opposite sides of each of the first and second set of RF contacts 345*a*, 345*b*. In particular, the zinc alloy anodes 371 are positioned between the transition between the tubular RF antenna 330, which may be steel, and the tool 350, which may include copper. This transition or interface is generally a concern for corrosion, as will be appreciated by those skilled in the art.

Additionally, a stack of spiral V-rings 372 (e.g. including at least 3 spiral V-rings) may be positioned outside each of the zinc alloy anodes 371. The stack of spiral V-rings 372 may be aromatic polyester filled PTFE (Ekonol) rated for −157° C. to 285° C., for example, and are configured to isolate reservoir fluids from the RF contacts 345*a*, 345*b*. Of course, the spiral V-rings 372 may be a different material or another type of sealing device or ring. A respective bottom and top adapter 373*a*, 373*b* surround each V-ring stack 372. The bottom adapter 373*a* may be glass filled PEEK (W4686) having a temperature rating of −54° C. to 260° C., and the top adapter 373*b* may be glass filled PTFE (P1250) having a temperature rating of −129° C. to 302° C. The bottom and top adapters 373*a*, 373*b* may each be a different material.

Figure 41:
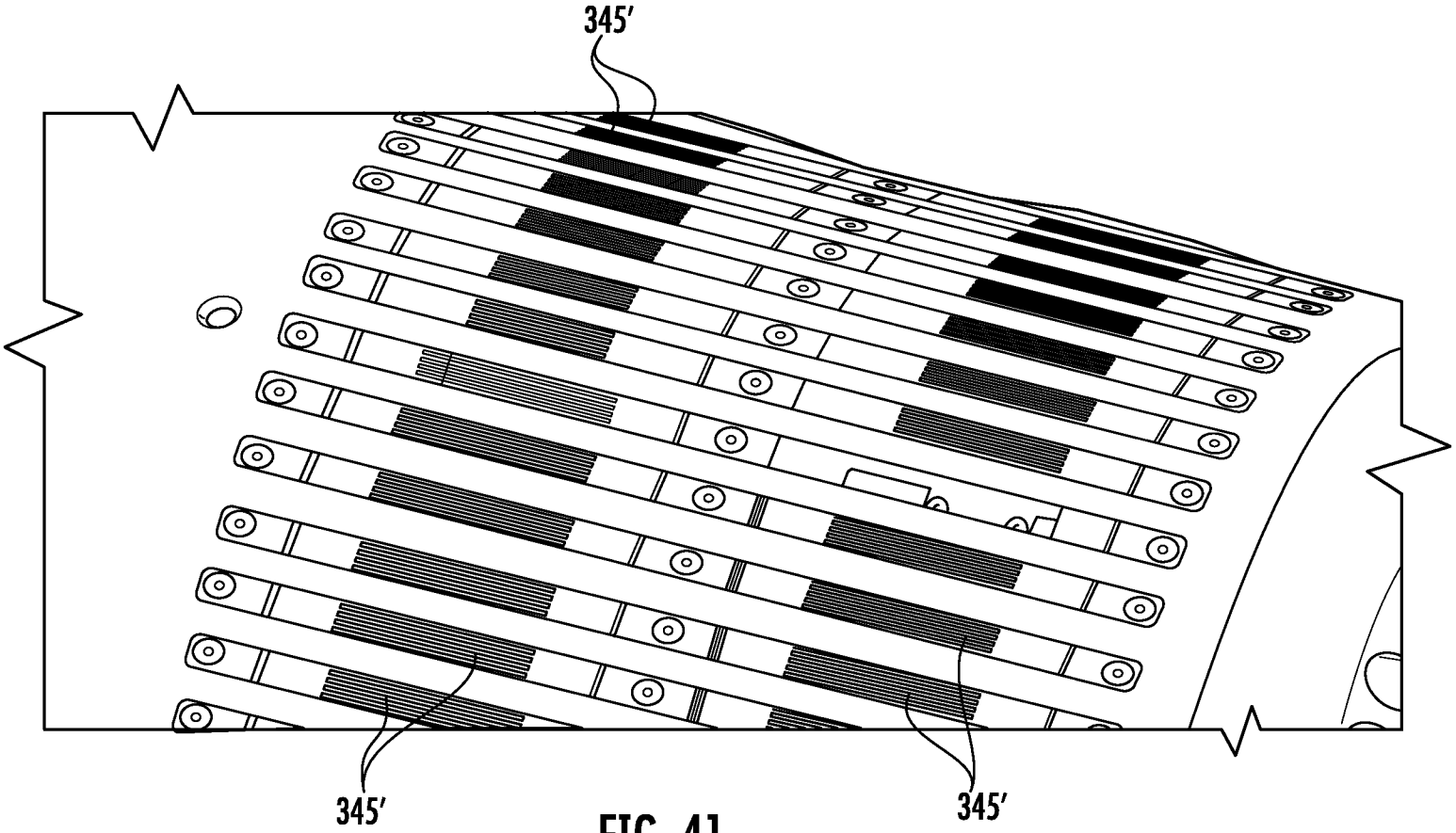
FIG. 41 is a schematic diagram of a portion of a set of RF contacts in accordance with another embodiment of the present invention.

Referring briefly to FIG. 41, in another embodiment, each of the RF contacts 345' may be in the form of a deployable contact that is moveable between a retracted position and a deployed position. As will be appreciated by those skilled in the art, the deployable RF contacts 345' may be hydraulically operated RF contacts and moved between the retracted and the deployed positions hydraulically. Of course, in other embodiments, other types of RF contacts may be used.

Figure 42:
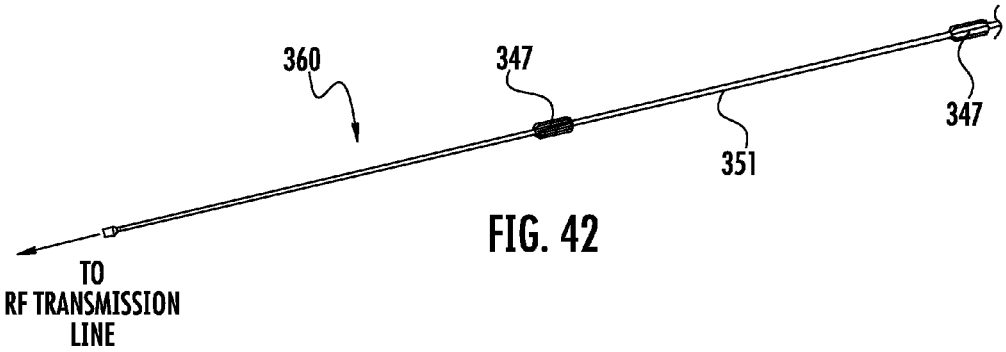
FIG. 42 is a schematic plan view of a guide member of a tool in accordance with an embodiment of the present invention.
Figure 43:
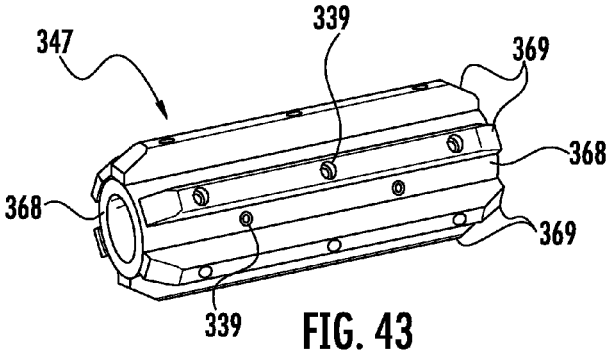
FIG. 43 is an enlarged plan view of the centralizer of the guide member of FIG. 42.
Figure 44:
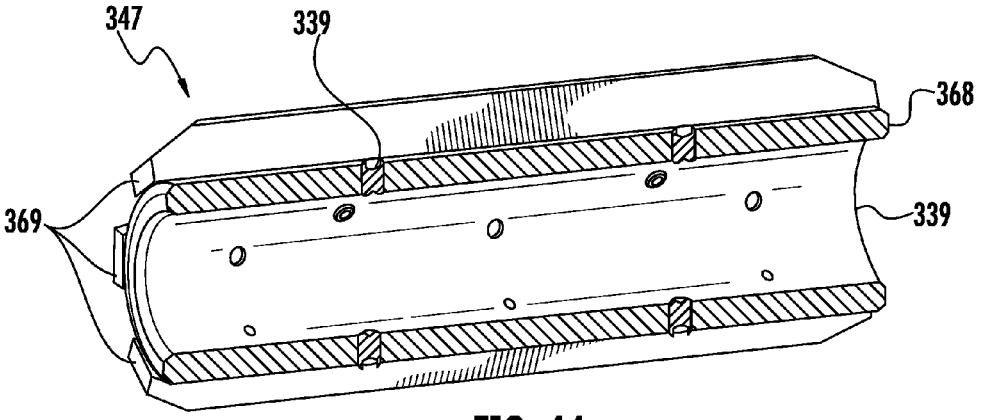
FIG. 44 is a cross-sectional view of centralizer of FIG. 43.

Referring again to FIGS. 35-40 and additionally to FIGS. 42-44, an outer tube 359 illustratively surrounds the RF transmission line 340. The tool 350 also includes a guide member 360 extending longitudinally outwardly from the distal end of the RF transmission line 340. The guide member 360 includes an elongate member 351 and longitudinally spaced apart centralizers 347 carried by the elongate member. While a plurality of centralizers 347 is illustrated, it will be appreciated that any number of centralizers may be carried by the elongate member 351, for example, a single centralizer.

Each centralizer 347 illustratively includes a tubular body 368 and longitudinally extending fins 369 spaced around a periphery of the tubular body. An exemplary centralizer 347 may be the coiled tubing centralizer available from Select Energy Systems of Calgary, Canada. The centralizers 347 advantageously maintain the RF transmission line 340 and tool 350 centered within the tubular RF antenna 330. Additionally, each centralizer 347 may include PTFE, which may reduce damage to the tool 350 and increase ease of slidably positioning the tool within the tubular RF antenna 330. Each centralizer 347 also illustratively includes set screws 339 to each of which full torque is applied to secure each centralizer to the elongate member 351. Additional centralizers 347 may be located elsewhere along the RF transmission line 340. The elongate member 351 may be provided by a series of tubular members coupled in end-to-end relation. It will be appreciated by those skilled in the art that the elongate member 351 may be at least two meters long, and more preferably 10 meters long, for example. More particularly, each elongate member 351 is typically about 8-10 meters long with space-out members or tubulars between 0.6 and 3.3 meters in 0.6 meter increments or roughly 24-33 feet in length with a relatively short tubular in 2 foot increments from 2 to 10 feet in length. In the illustrated embodiment, the elongate member 351 may have a length of about 45 meters, for example, or approximately the length of the half antenna minus 1% for thermal growth, with a centralizer 347 positioned within a 9 meter spacing, for example, or a close enough spacing so that the tubular members do not sag appreciably under their own weight.

Figure 35:
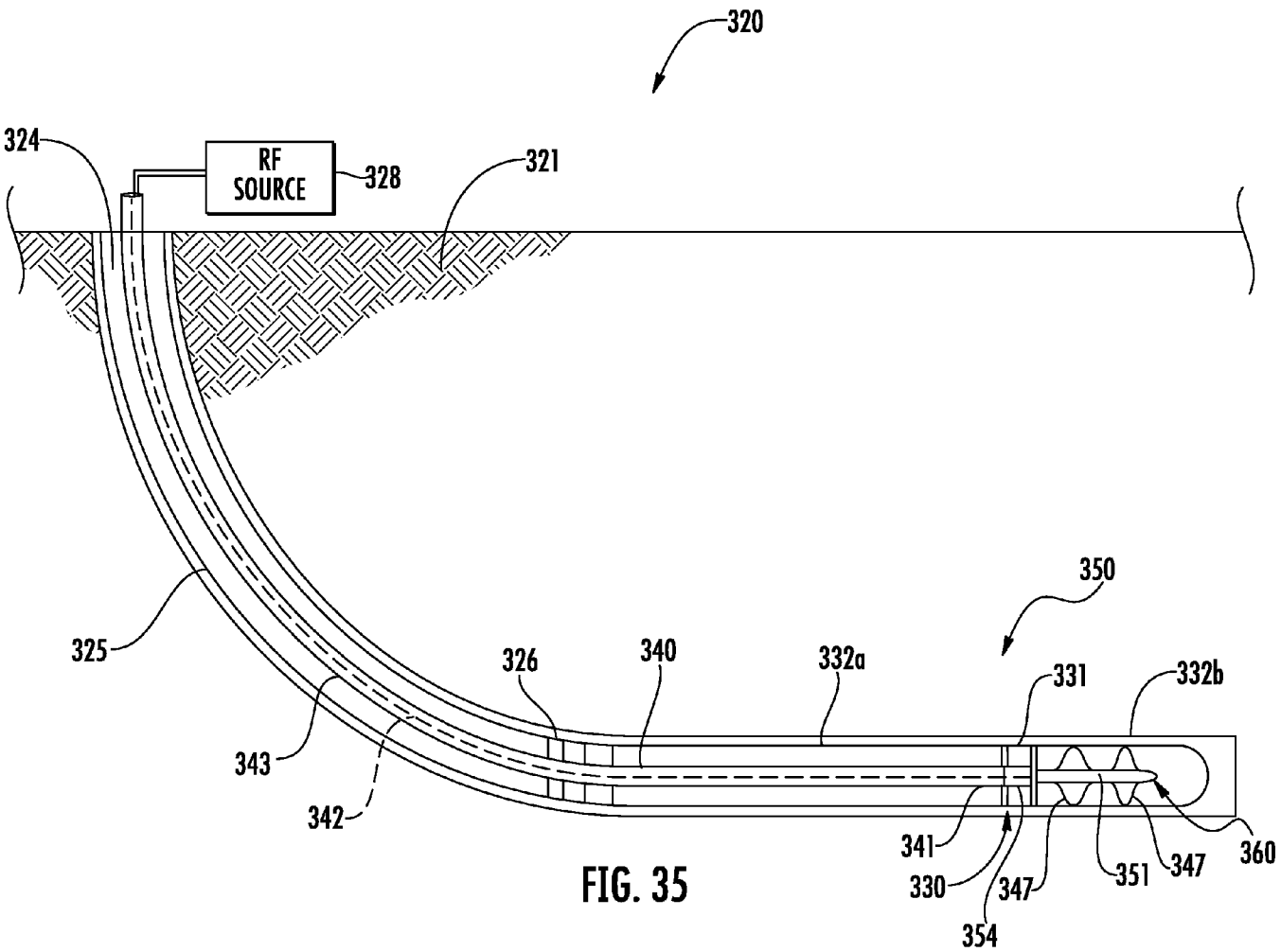
FIG. 35 is a schematic diagram of a subterranean formation including an apparatus in accordance with another embodiment of the present invention.
Figure 36:
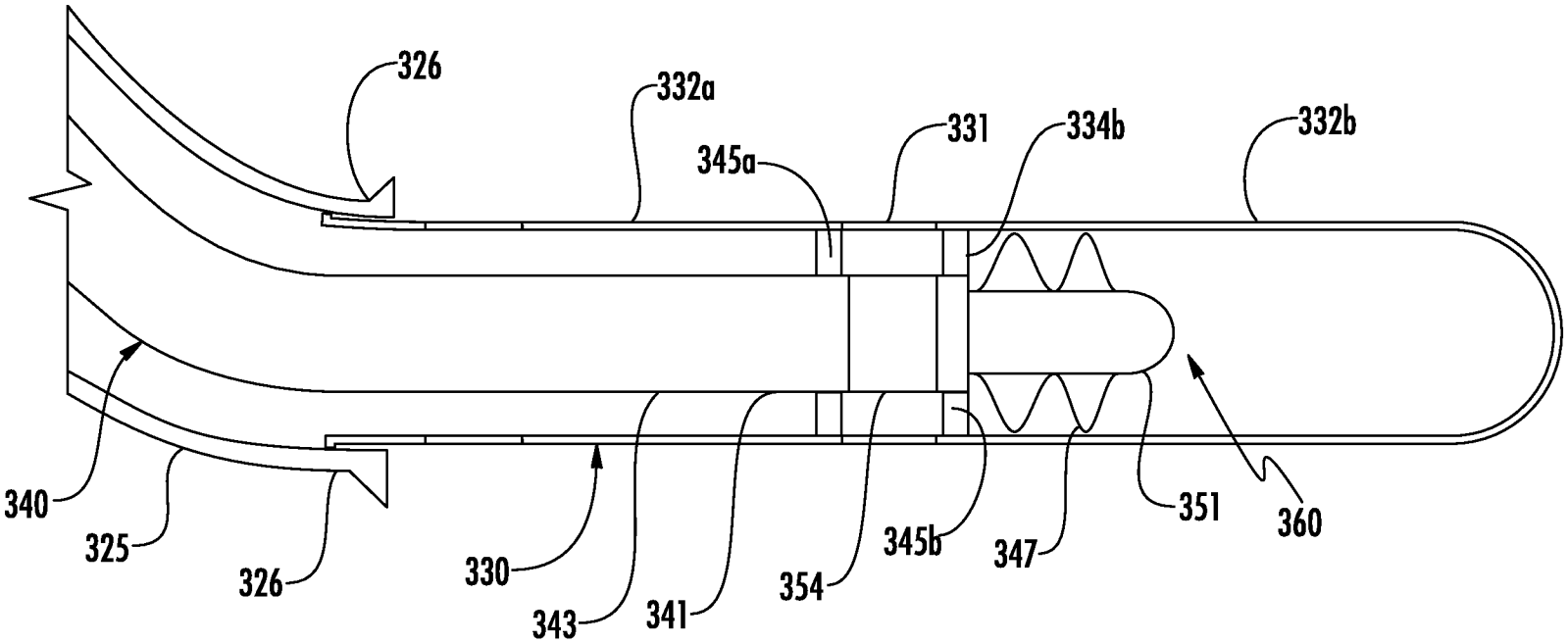
FIG. 36 is an enlarged schematic diagram of a portion of the apparatus of FIG. 35.
Figure 37:
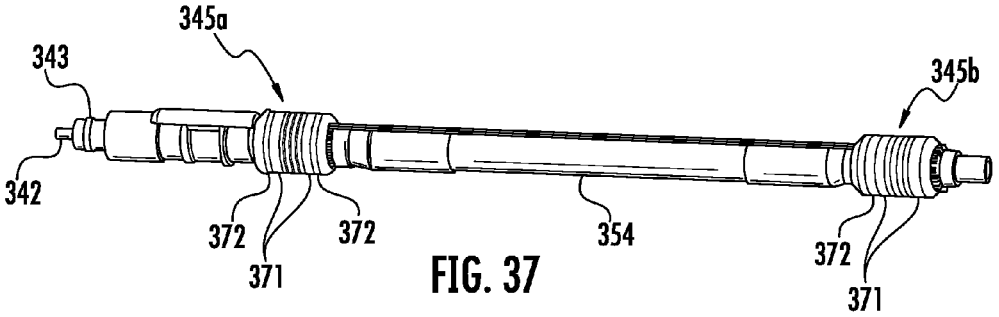
FIG. 37 is a schematic diagram a portion of the tool and inner and outer conductors of the apparatus of FIG. 36.
Figure 38:
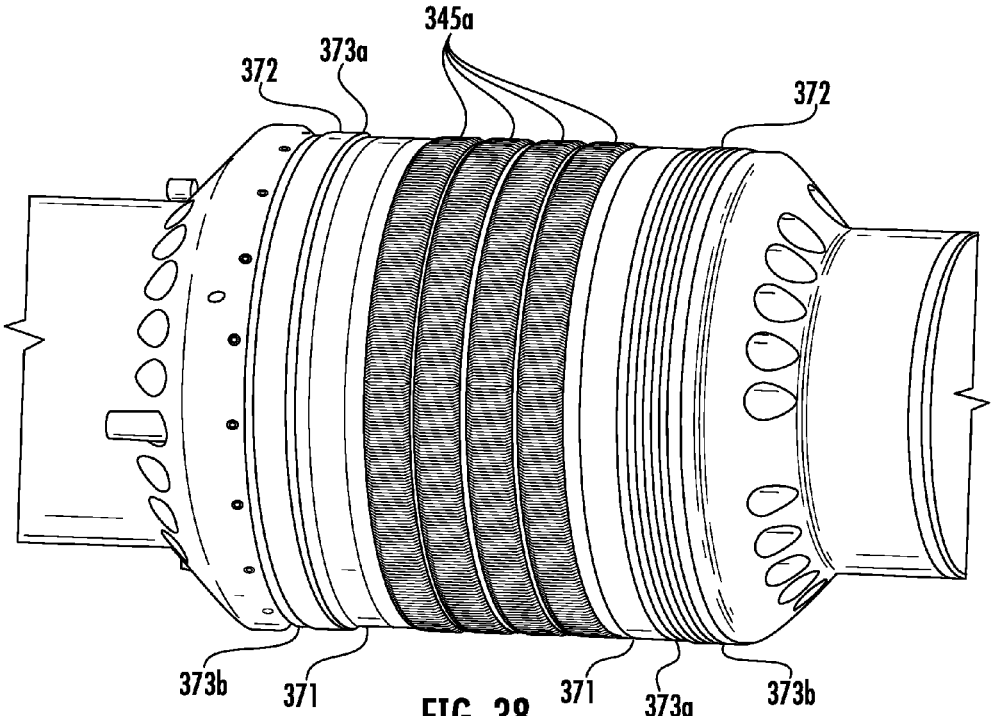
FIG. 38 is an enlarged schematic diagram of a first set of RF contacts of the tool of FIG. 37.
Figure 39:
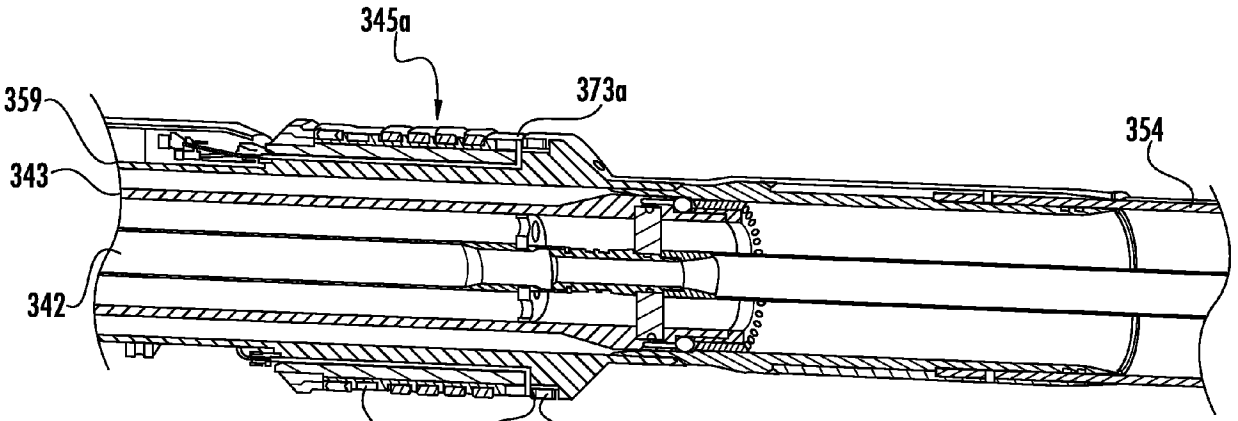
FIG. 39 is a schematic cross-sectional view of the first set of RF contacts of the tool of FIG. 37.
Figure 40:
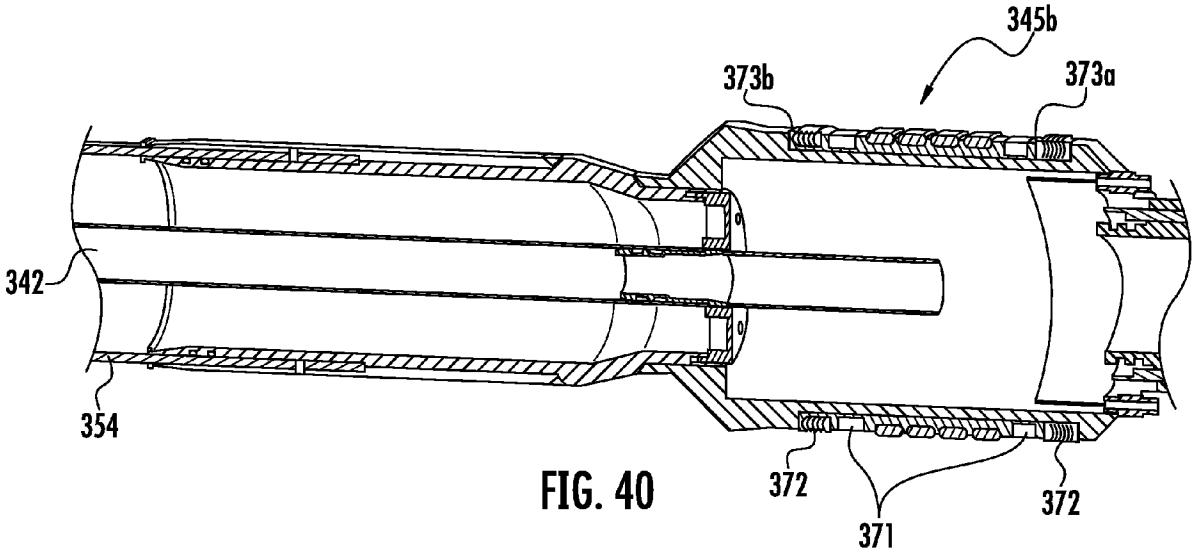
FIG. 40 is a schematic cross-sectional view of the second set of RF contacts of the tool of FIG. 37.

An RF source 328 supplies RF power via the RF transmission line 340, to the tubular RF antenna 330 so that the tubular RF antenna heats the hydrocarbon resources in the subterranean formation 321 (FIG. 35).

Figure 45:
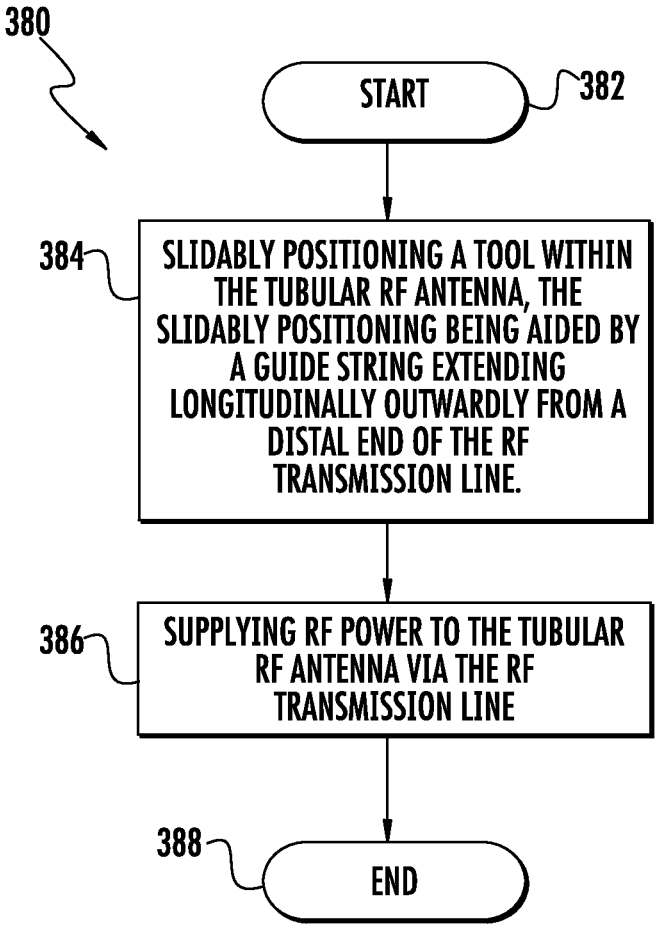
FIG. 45 is a flow diagram of a method of heating hydrocarbon resource in accordance with an embodiment of the present invention.

Referring now to the flowchart 380 in FIG. 45, beginning at Block 382 a method aspect is directed to a method for heating hydrocarbon resources in a subterranean formation 321 having a wellbore 324 therein with a tubular RF antenna 330 within the wellbore. At Block 384 the method includes slidably positioning a tool 350 within the tubular RF antenna 330. The tool 350 includes an RF transmission line 340 and at least one RF contact 345*a*, 345*b* coupled to a distal end 341 of the RF transmission line and that is biased in contact with the tubular RF antenna 330. The slidably positioning is aided by a guide member 360 extending longitudinally outwardly from the distal end 341 of the RF transmission line 340. The method also includes, at Block 386, supplying RF power to the tubular RF antenna 330 via the RF transmission line 340. The method ends at Block 388.

Figure 46:
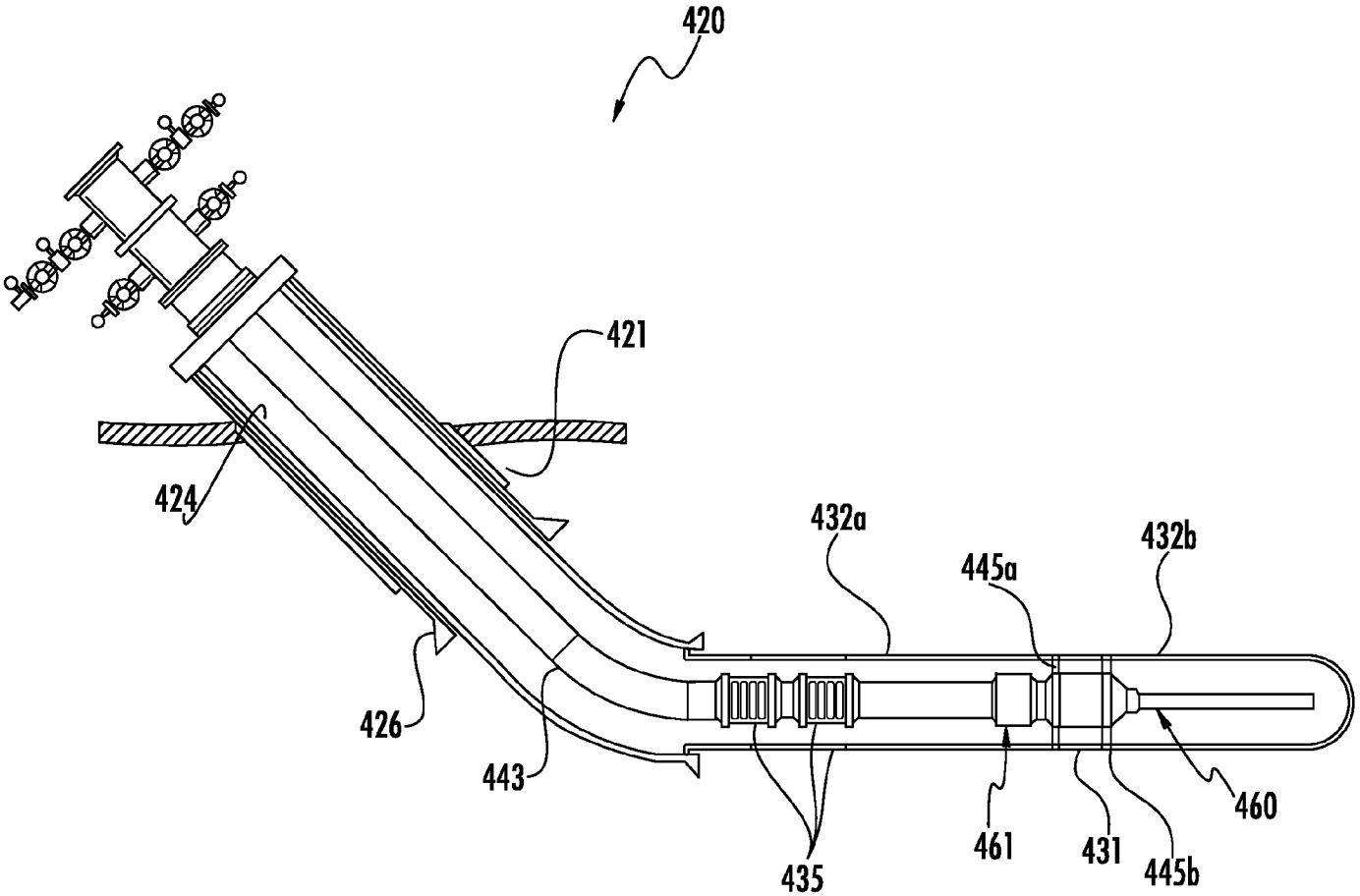
FIG. 46 is a schematic diagram of a subterranean formation including an apparatus in accordance with another embodiment of the present invention.
Figure 47:
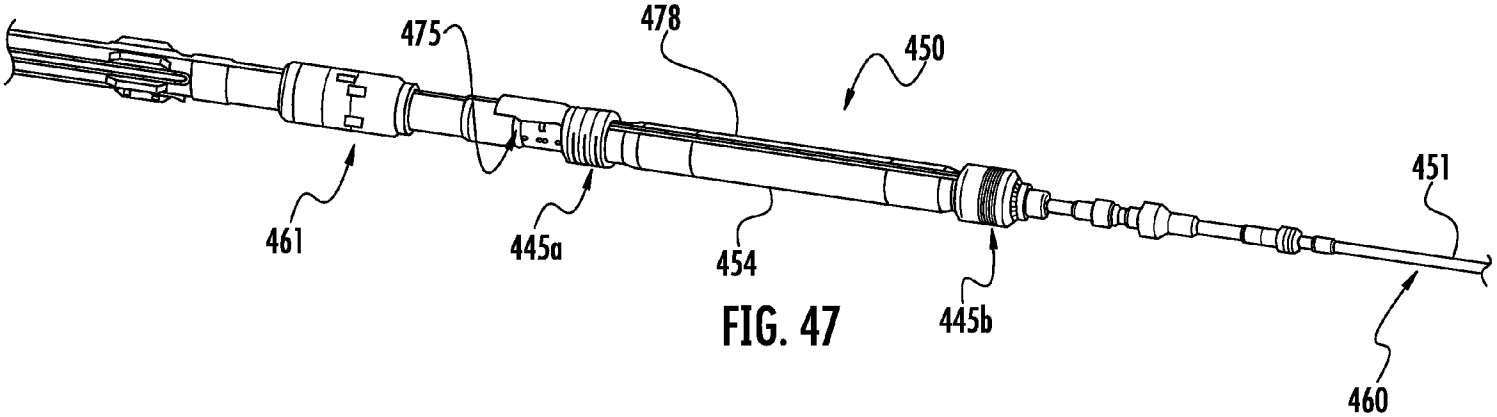
FIG. 47 is a detailed plan view of a portion of a tool in accordance with an embodiment of the present invention.
Figure 48:
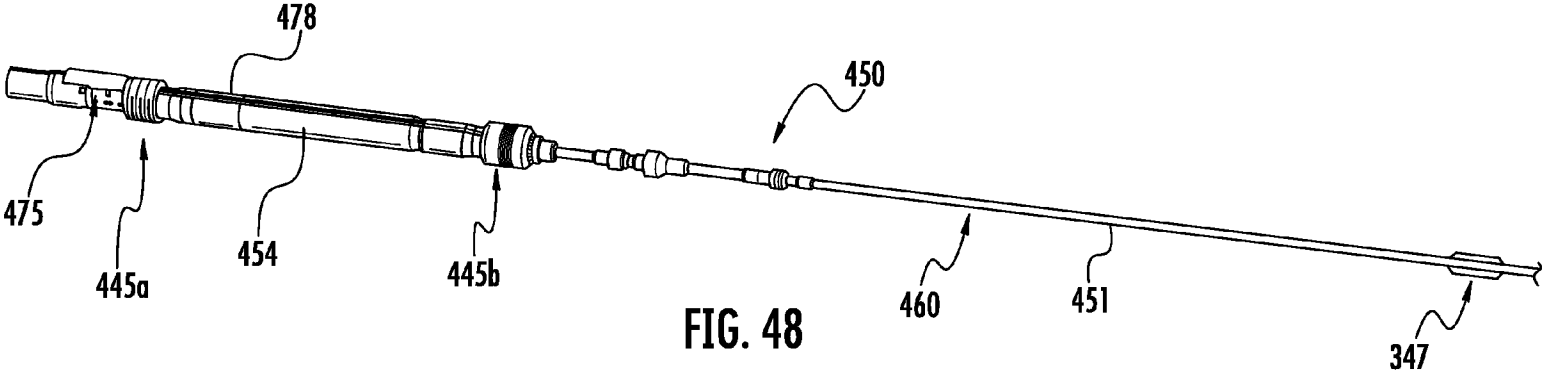
FIG. 48 is a detailed plan view of another portion of the tool of FIG. 47.

Referring now to FIGS. 46-48, it will be appreciated by those skilled in the art that while several different embodiments are described above, any one or more of the embodiments described herein may be used in conjunction with other embodiments. For example, as illustrated, an apparatus 420 may include all of the RF contacts 445*a*, 445*b*, anchoring device 461, dielectric grease injector 475, and guide member 460, along with one or more baluns 435 or chokes. Additional details regarding baluns 435 and associated dielectric sections can be found in U.S. patent application Ser. No. 14/167,039 filed Jan. 29, 2014, entitled, HYDROCARBON RESOURCE HEATING SYSTEM INCLUDING COMMON MODE CHOKE ASSEMBLY AND RELATED METHODS, assigned to the present assignee, and the entire contents of which are hereby incorporated by reference. Of course, other and/or additional components of the tool may additionally be used, for example, tubular sections to define fluid passageways. Moreover, it will be appreciated that reference numerals in different centuries, which may not be specifically described, are used to describe like elements in different embodiments, which have been described in detail above.

As will be appreciated by those skilled in the art, the embodiments of the apparatus described herein may be particularly advantageous in that it may provide increased reliability and flexibility of use. In particular, the apparatus may be reused, for example, the apparatus may be removed from a given wellbore and replaced in another wellbore. This may reduce costs relative to multiple fixed apparatuses, for example.

Many modifications and other embodiments of the invention will also come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An apparatus for heating hydrocarbon resources in a subterranean formation having a wellbore therein, the apparatus comprising:

a tubular radio frequency (RF) antenna within the wellbore; and a tool slidably positioned within said tubular RF antenna and comprising an RF transmission line, at least one RF contact coupled to a distal end of said RF transmission line and biased in contact with said tubular RF antenna, and a guide member extending longitudinally outwardly from the distal end of said RF transmission line.

2. The apparatus according to claim 1 wherein said guide member comprises an elongate member and at least one centralizer carried thereby.

3. The apparatus according to claim 2 wherein said at least one centralizer comprises a plurality of longitudinally spaced apart centralizers.

4. The apparatus according to claim 2 wherein said at least one centralizer comprises a tubular body and a plurality of longitudinally extending fins spaced around a periphery of said tubular body.

5. The apparatus according to claim 1 wherein said at least one RF contact comprises at least one conductive wound spring.

6. The apparatus according to claim 1 wherein said at least one RF contact comprises at least one deployable RF contact moveable between a retracted position and a deployed position.

7. The apparatus according to claim 1 wherein said tubular RF antenna comprises first and second conductive sections and an insulator therebetween.

8. The apparatus according to claim 7 wherein said RF transmission line comprises an inner conductor and an outer conductor surrounding said inner conductor; and wherein said at least one RF contact comprises:

a first set of RF contacts coupled to the outer conductor and biased in contact with an adjacent inner surface of the first conductive section; and a second set of RF contacts coupled to the inner conductor and biased in contact with an adjacent inner surface of the second conductive section.

9. The apparatus according to claim 1 wherein said tool further comprises an outer tube surrounding said RF transmission line.

10. The apparatus according to claim 1 further comprising an RF power source configured to supply RF power, via said RF transmission line, to said tubular RF antenna.

11. A tool to be slidably positioned within a tubular radio frequency (RF) antenna within a wellbore in a subterranean formation, the tool comprising:

an RF transmission line;

at least one RF contact coupled to a distal end of said RF transmission line and to be biased in contact with the tubular RF antenna; and a guide member extending longitudinally outwardly from the distal end of said RF transmission line.

12. The tool according to claim 11 wherein said guide member comprises an elongate member and at least one centralizer carried thereby.

13. The tool according to claim 12 wherein said at least one centralizer comprises a plurality of longitudinally spaced apart centralizers.

14. The tool according to claim 12 wherein said at least one centralizer comprises a tubular body and a plurality of longitudinally extending fins spaced around a periphery of said tubular body.

15. The tool according to claim 11 wherein said at least one RF contact comprises at least one conductive wound spring.

16. The tool according to claim 11 wherein said at least one RF contact comprises at least one deployable RF contact moveable between a retracted position and a deployed position.

17. The tool according to claim 11 wherein the tubular RF antenna comprises first and second conductive sections and an insulator therebetween; wherein said RF transmission line comprises an inner conductor and an outer conductor surrounding said inner conductor; and wherein said at least one RF contact comprises:

a first set of RF contacts coupled to the outer conductor and to be biased in contact with an adjacent inner surface of the first conductive section; and a second set of RF contacts coupled to the inner conductor and to be biased in contact with an adjacent inner surface of the second conductive section.

18. The tool according to claim 11 further comprising an outer tube surrounding said RF transmission line.

19. A method for heating hydrocarbon resources in a subterranean formation having a wellbore therein with a tubular radio frequency (RF) antenna within the wellbore, the method comprising:

slidably positioning a tool within the tubular RF antenna and comprising an RF transmission line, and at least one RF contact coupled to a distal end of the RF transmission line and to be biased in contact with the tubular RF antenna;

the slidably positioning aided by a guide member extending longitudinally outwardly from the distal end of the RF transmission line; and supplying RF power to the tubular RF antenna via the RF transmission line.

20. The method according to claim 19 wherein the guide member comprises an elongate member and at least one centralizer carried thereby.

21. The method according to claim 20 wherein the at least one centralizer comprises a plurality of longitudinally spaced apart centralizers.

22. The method according to claim 20 wherein the at least one centralizer comprises a tubular body and a plurality of longitudinally extending fins spaced around a periphery of the tubular body.

23. The method according to claim 20 wherein the at least one RF contact comprises at least one conductive wound spring.

24. The method according to claim 19 wherein the at least one RF contact comprises at least one deployable RF contact; and further comprising moving the at least one deployable RF contact from a retracted position to a deployed position.

25. The method according to claim 19 wherein the tubular RF antenna comprises first and second conductive sections and an insulator therebetween; wherein the RF transmission line comprises an inner conductor and an outer conductor surrounding the inner conductor; and wherein the at least one RF contact comprises:

a first set of RF contacts coupled to the outer conductor and to be biased in contact with an adjacent inner surface of the first conductive section; and a second set of RF contacts coupled to the inner conductor and to be biased in contact with an adjacent inner surface of the second conductive section.

26. The method according to claim 19 further comprising an outer tube surrounding the RF transmission line.

* * * * *